US007508363B2

(12) United States Patent
Hashimoto

(10) Patent No.: US 7,508,363 B2
(45) Date of Patent: Mar. 24, 2009

(54) DATA DRIVER CIRCUIT FOR DISPLAY DEVICE AND DRIVE METHOD THEREOF

(75) Inventor: Yoshiharu Hashimoto, Kanagawa (JP)

(73) Assignee: NEC Electronics Corporation, Kanagawa (JP)

( * ) Notice: Subject to any disclaimer, the term of this patent is extended or adjusted under 35 U.S.C. 154(b) by 718 days.

(21) Appl. No.: 10/956,048

(22) Filed: Oct. 4, 2004

(65) Prior Publication Data

US 2005/0078079 A1 Apr. 14, 2005

(30) Foreign Application Priority Data

Oct. 10, 2003 (JP) ..... 2003-352841

(51) Int. Cl.
*G09G 3/30* (2006.01)

(52) U.S. Cl. ..... 345/76; 345/77; 345/89; 345/102; 345/690; 345/211

(58) Field of Classification Search ..... 345/76–82, 345/87, 89, 98–100, 102
See application file for complete search history.

(56) References Cited

U.S. PATENT DOCUMENTS 6,392,620 B1 * 5/2002 Mizutani et al. ..... 345/88
6,618,031 B1 9/2003 Bohn, Jr. et al.
6,956,547 B2 10/2005 Bae et al.
7,002,539 B2 * 2/2006 Shimada ..... 345/88

FOREIGN PATENT DOCUMENTS

CN 1395227 A 2/2003
JP 09-152850 10/1997

* cited by examiner

*Primary Examiner*—Duc Q Dinh
(74) *Attorney, Agent, or Firm*—Foley & Lardner LLP

(57) ABSTRACT

The data driver circuit for display device comprising an expansion hold circuit, that expands and holds a plurality of serially inputted digital image signals in parallel a first current driver circuit that is connected to the expansion hold circuit and comprises a plurality of current drivers for generating gradation currents corresponding with the digital image signals; a first switching circuit constituted by a plurality of switch groups connected to respective outputs of the plurality of current drivers; and a switching control circuit that switches at least the plurality of current drivers by controlling the first switching circuit and controls at least one of an order of expansion in the expansion hold circuit of the digital image signals, the direction thereof or number of rotations.

2 Claims, 25 Drawing Sheets

FIG. 17
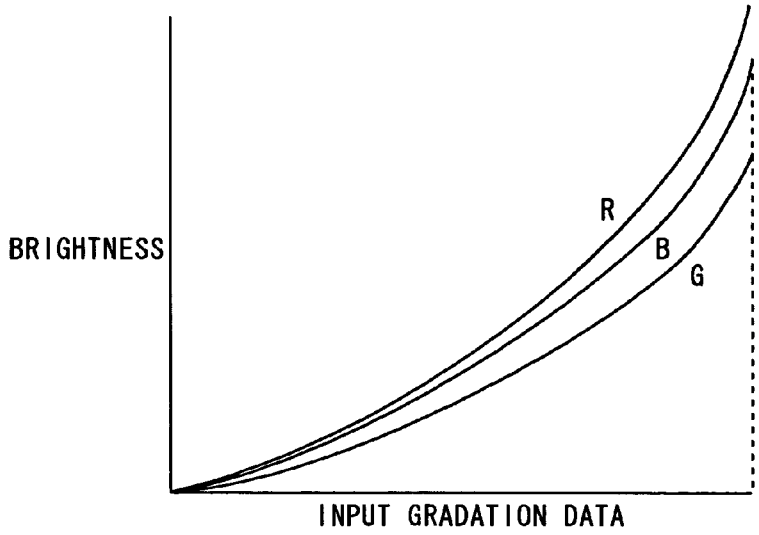
FIG. 18
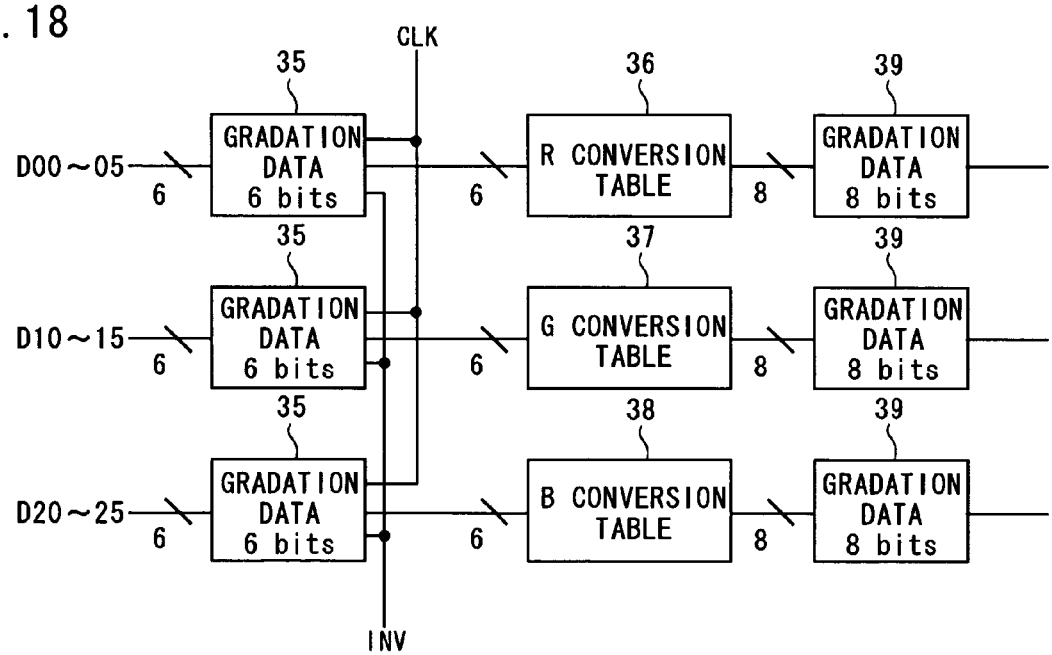
FIG. 19
| INPUT DATA | CONVERTED R DATA | CONVERTED G DATA | CONVERTED B DATA |
|---|---|---|---|
| 00 0000 | 0000 0000 | 0000 0000 | 0000 0000 |
| 00 0001 | 0000 0010 | 0000 0001 | 0000 0010 |
| 00 0010 | 0000 0100 | 0000 0011 | 0000 0100 |
| : | : | : | : |
| 11 1101 | 1101 1101 | 1010 0000 | 1100 0010 |
| 11 1110 | 1110 0000 | 1010 0100 | 1100 0100 |
| 11 1111 | 1110 0011 | 1010 1000 | 1100 1000 |

DATA DRIVER CIRCUIT FOR DISPLAY DEVICE AND DRIVE METHOD THEREOF

BACKGROUND OF THE INVENTION

1. Field of the Invention

The present invention relates to a driver circuit for a matrix-type display device and, more particularly, to a data electrode driver circuit that allows a gradation display according to current values by a display device that comprises a light emitting element for each pixel to gradation display and to a drive method.

2. Description of the Related Art

Liquid-crystal display devices and so forth are being implemented in accordance with the development of display device technology in recent years. An organic EL display device possesses characteristics such as a thinner shape and wider viewing angle than liquid crystal display devices.

Organic EL display devices include passive-matrix-type display devices and active-matrix-type display devices in which a TFT (Thin Film Transistor) is employed in a pixel circuit. Active-matrix-type display devices can be further classified into voltage-drive-type display devices and current-drive-type display devices on the basis of the drive method.

FIG. 2 shows a simplified view of a matrix-type display device.

Respective pixel circuits 6 are arranged at the points of intersection between a plurality of control electrodes 5, which are provided at predetermined intervals in the row direction, and a plurality of data electrodes 4, which are provided at predetermined intervals in the column direction. The pixel circuits employ about four or five TFTs to reduce variations in the current of the pixel circuits, whereby the image quality is enhanced. Further, although not illustrated, the display device also comprises a power supply for a data electrode driver circuit and a power supply for a control electrode driver circuit, and a control circuit for controlling the data electrode driver circuit and so forth. FIG. 27 shows a data electrode driver circuit that drives conventional data electrodes and pixel circuits.

Serially inputted digital image signals D00 to Dxx are held by a data conversion circuit 82 for the duration of a clock signal cycle in sync with a clock signal CLK. A data inversion signal INV is used in cases where half or more of the data of D00 to Dxx is to be inverted in comparison with previous data, and reduces the current consumed by the digital image signal wiring (data bus).

For example, if the previous data is 000011 and the next data is 111111, four of the six image signals are inverted. In this case, the data inversion signal INV is rendered 1 by the side from which data are outputted (CPU and so forth) and the inputted image signal is thus inverted from 111111 to 000000 and then inputted to the data conversion circuit. When signals inputted from the CPU side to the driver circuit side are inputted such that the image signal is 000000 and the INV is 1, the desired signal 111111 can be obtained as a result of inverting the image signal from 000000 to 111111 by a data conversion circuit 82.

If the previous data is 111111 and the present data is 110011, only two of the six image signals are inverted. In this case, data inversion is not executed by the side inputting the data (CPU and so forth). When the signals inputted from the CPU side are inputted such that the signal INV is 0 and the image signal is 110011, the desired signal 110011 is obtained without inversion being performed by the data conversion circuit 82.

A shift register 81 generates sampling signals SP sequentially in sync with the clock signal CLK. When a start signal STH is inputted, the shift register 81 generates sampling signals SP from the outputs of flip-flop circuits (abbreviated to 'FF circuits' hereinafter) as shown in FIG. 28. That is, the shift register 81 generates a sampling signal SP1 from the output of an FF circuit 81*a*, generates a sampling signal SP2 from the output of an FF circuit 81*b*, generates a sampling signal SP3 from the output of an FF circuit 81*c*, and generates a sampling signal SP4 from the output of an FF circuit 81*d*, and then sequentially holds digital image signals in a data register circuit 12 in sync with the sampling signals SP1, SP2, SP3, and then SP4.

When the capture of a predetermined number of image signals ends, the digital image signals held by the data register circuit 12 are all transferred to and stored in a data latch circuit 13 at the same time by means of a latch signal STB. A current driver circuit A 14 drives data electrodes 4 by outputting predetermined current values in accordance with the image signal.

FIG. 29 provides a detailed view of the current driver circuit A 14 and the data latch circuit 13.

Generally, because the voltage of a display-device drive unit is high in comparison with the voltage of a logic unit as far as the data latch circuit 13, a level shift circuit 13*c* for converting a low voltage to a high voltage is provided between the current driver circuit A 14 and a data latch 13*a*.

If a image signal is an n-bit image signal, transistors (abbreviated to 'Tr' hereinbelow) 85*a* to 85*f* operate as n switches and perform control in accordance with the image signal. Tr 84*a* to 84*f* establish current values that are weighted with respect to a current value I of a reference current device 86 by means of n fixed current devices. For example, current drivers 14*k* with 64 levels, where n=6, are implemented. Current values in the order Tr 84*a*, 84*b*, 84*c*, 84*d*, 84*e*, and then 84*f* are then 1×I, 2×I, 4×I, 8×I, 16×I, and 32×I.

For example, if the image signal is 000000 and Tr 85*a* to Tr 85*f* are all OFF, a current does not flow to a load 87. Further, if the image signal is 111111 and Tr 85*a* to Tr 85*f* are all ON, a current of 63×I then flows to the load 87. In addition, the number of data electrodes 4, the number of control electrodes 5, and the number of current drivers 14*k* and so forth are optional depending on the number of pixels in the panel and the constitution of the pixel circuits. The load 87 is constituted by the data electrodes 4 and the pixel circuits 6.

When there is a current variation in the current drivers driving the pixel circuits, unevenness in the display (vertical line unevenness) then occurs. Generally, although a certain number of dot defects are permissible, not a single line defect can be permitted.

Therefore, in order to balance the variation in the characteristics of the A/D converter, D/A converter, amplifier, and so forth when an analog image signal is received, the provision of switching means on the input and output sides of the D/A converter, amplifier, and so forth to allow switching in optional cycles has been proposed (See Japanese Unexamined Patent Application Publication No. 09-152850 (first, second, and fifth drawings)).

However, the driving of this conventional display device several is confronted by several problems.

The first problem is that vertical line unevenness caused by variations in characteristics such as the current value of the current driver circuit is produced and there is a drop in the image quality.

The second problem is that, in the current drive method, the drive time is determined by the current value, load capacitance and drive voltage. Hence, when the number of pixels is high, the drive time is short and the load capacitance is large, meaning that a large current value is required and the electrical power consumption of the display device is then large.

For example, one horizontal period is 1/(frame frequency× number of scanning electrodes), and, hence, if the frame frequency is 60 Hz and the number of scanning electrodes is 320, one horizontal period is 1/(60×320)=approximately 52 μsec (because there is actually a vertical blanking period and a horizontal blanking period, one horizontal period is approximately 50 μsec).

In a voltage driving method for a liquid crystal display device or the like, data electrodes can be driven at a high speed of approximately 1.5 μsec by an amplifier with a high drive performance such as a voltage follower. Approximately 30 data electrodes can be written by one D/V converter (the conversion of a digital signal to a voltage-value analog value is abbreviated to 'D/V conversion' and the conversion of a digital signal to a current-value analog value is abbreviated to 'D/I conversion'), and hence there may be 720/30=24 D/V converters.

In a current drive method for an organic EL display device, if driving takes place by means of a minute current of about 1 μA and the load capacitance is 10 pF, the time taken is t=CV/I=10 pF×5V/1 μA=50 μsec. That is, because time-division driving, which is generally performed by liquid-crystal display devices, is impossible, 720 D/I converters are required, which is the same number as the number of data electrodes.

Therefore, in the voltage drive method, driving can be performed at high speed by means of D/V converters, and therefore the write time is substantially constant irrespective of the image signal. However, in the current drive method, the write time is determined by the current value and load capacitance, and it is therefore difficult to drive a plurality of data electrodes using time division by means of a single D/I converter. Hence, the same number of D/I converters as data electrodes must be provided. Further, in the current drive method, if the number of pixels increases, the load capacitance increases and the drive time is shortened, meaning that there is the problem that the drive time is inadequate.

A third problem is that a conventional current driver circuit is unable to obtain current values that match the Gamma characteristic.

A fourth problem is that the circuit scale increases. In the technology in Japanese Unexamined Patent Application Publication No. 09-152850, an inputted signal is an analog signal, which is first A/D converted and then D/A converted and switching means are provided on the input and output sides of the D/A conversion to balance the variations in the characteristics of the D/A conversion circuit.

However, in small-scale display devices such as the latest cellular phones, the definition and number of gradations is increasing and the number of pixels is QVGA (240×RGB×320 pixels) or more. Advances in digital technology are leading to 6-bit or higher digital signals.

Therefore, when switching means are provided on the input side of the D/A conversion circuit, the number of switches connected to the input electrode of a single D/A converter is then (number of D/A converters×number of bit of digital image signal), and hence the number of the switches is huge. In this case, in the switching of image signals, the required number of switches on the input side of a single D/I converter is as many as 720×6=4,320, and, therefore, for the whole of the display device, as many as 720×3,110,400 switches are required.

SUMMARY OF THE INVENTION

According to a first effect, the display-device driver circuit comprises an expansion hold circuit that expands in parallel and holds a plurality of serially inputted digital image signals that comprises circuits such as a switching circuit that switches the input position of a start signal, a switching circuit that switches a sampling signal generated by a shift register circuit, or a data shift circuit that shifts the digital image signals thus held; a first current driver circuit that is connected to the expansion hold circuit and constituted by a plurality of current drivers that generates gradation current corresponding with the digital image signals; a first switching circuit that is constituted by a plurality of switch groups connected to the respective outputs of the plurality of current drivers, wherein digital image signal switching can be implemented by means of a small number of switches in the switching circuit by switching the start signal or sampling signal by means of a circuit upstream of the hold circuit such as a data register circuit, and favorable image quality can be obtained by dispersing the variation in the characteristics of the first current driver circuit in time and space.

According to a second effect, it is possible to reduce the data electrode driver circuit to approximately ⅓ by dividing one frame period into a plurality of subframe periods that are light emission periods for each RGB color and a non-display period and providing a switching circuit for driving a plurality of data electrodes using time division by means of a single current driver. Further, by providing a non-display period, favorable image quality can be obtained even for a moving image display because such provision has the effect of erasing an afterimage. Brightness correction can also be performed by changing the subframe period for each RGB color.

According to a third effect, by driving data electrodes and pixel circuits by means of a first current driver circuit, which converts a digital image signal to an analog gradation current, a circuit, which holds a voltage rendered by referencing the gradation current value of the first current driver circuit, and a driver circuit that generates a current value corresponding with the voltage it is possible to prevent an increase in the circuit scale of the first current driver circuit even when there is increased pixel density and to reduce the electrical power consumed by the display device.

According to a fourth effect, favorable image quality can be obtained by providing a data conversion circuit that possesses a function to correct the brightness or correct the temperature for each RGB color upon receiving serially inputted digital image signals.

The above and other objects, features and advantages of the present invention will become more fully understood from the detailed description given hereinbelow and the accompanying drawings which are given by way of illustration only, and thus are not to be considered as limiting the present invention.

BRIEF DESCRIPTION OF THE DRAWINGS

The above and other objects, advantages and features of the present invention will be more apparent from the following description taken in conjunction with the accompanying drawings, in which:

FIG. 17 is a characteristic of inputted color data and brightness;

FIG. 18 provides a detailed view of the data conversion circuit of the first embodiment of the present invention;

FIG. 19 is a data conversion example of the first embodiment of the present invention;

DESCRIPTION OF THE PREFERRED EMBODIMENTS

Embodiments of the present invention will be described hereinbelow with reference to the drawings.

First Embodiment

Figure 1:
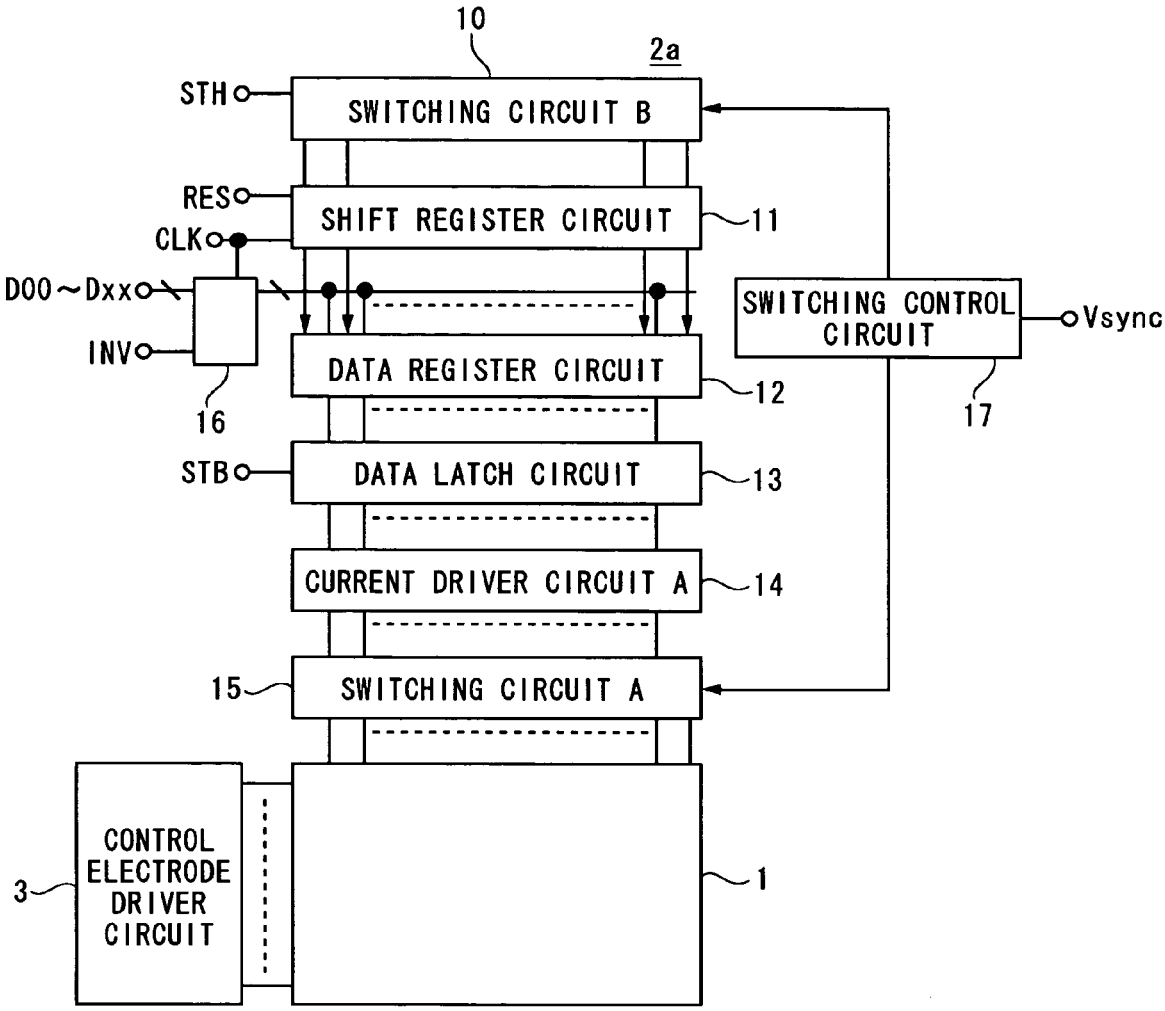
FIG. 1 is a data electrode driver circuit of a first embodiment of the present invention.
Figure 2:
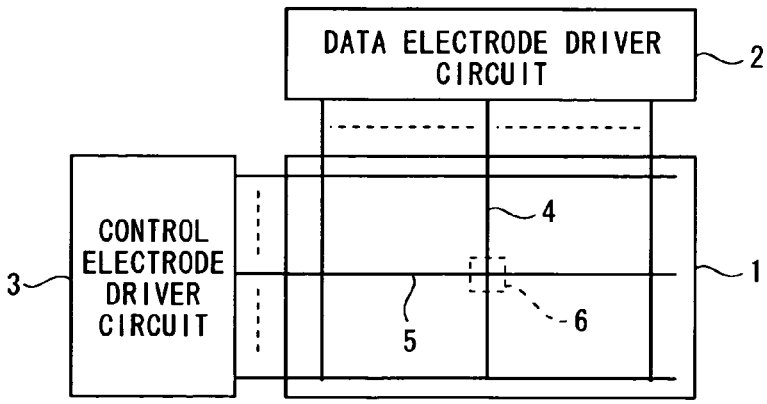
FIG. 2 is a block diagram of the display-device driver circuit of the present invention.
Figure 6:
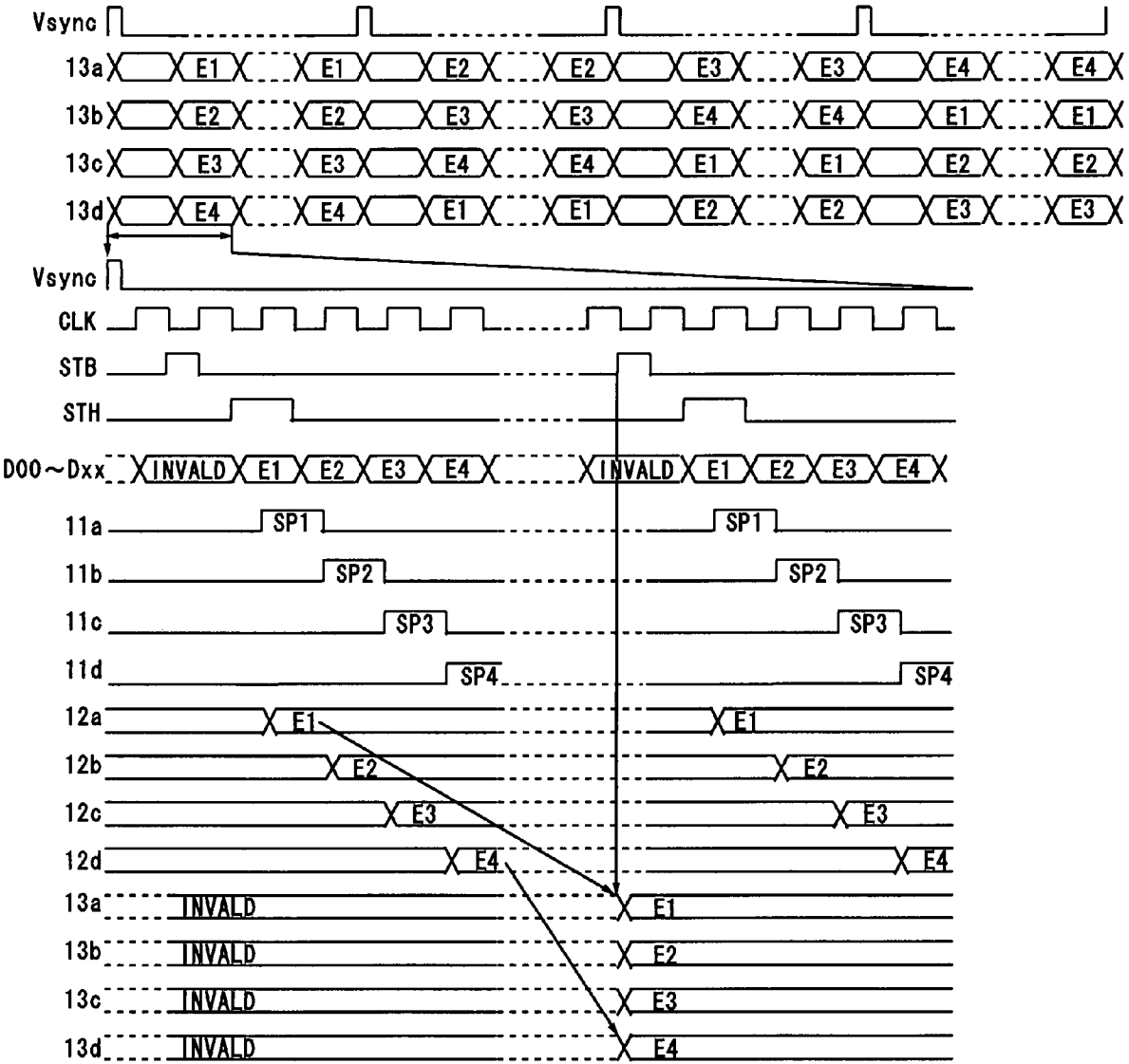
FIG. 6 is a timing chart for the data electrode driver circuit of the first embodiment of the present invention.

FIG. 2 shows a block diagram of the display device of the present invention, FIG. 1 shows a block diagram of a data electrode driver circuit 2*a* of the present invention, and FIG. 6 shows a timing chart for the display device shown in FIG. 1.

The constitution and operation of each part will now be described.

In order to drive the display device, in addition to the circuits illustrated here, a power supply circuit, a circuit for generating a clock signal or similar, and a circuit for controlling the clock signal or similar are required. However, the present invention relates to a data electrode driver circuit as mentioned earlier in the Field of the Invention. Therefore, the power supply circuits and so forth will not be illustrated or described. Further, a detailed description of the control electrode driver circuit that drives the control electrodes, which are orthogonal to the data electrodes, is not provided.

First, a data conversion circuit 16 will be described with reference to FIGS. 17, 18, and 19.

The data conversion circuit 16 possesses a function to hold at least digital image signals D00 to Dxx, which are serially inputted in sync with the clock signal, for the duration of the clock cycle, and has other functions which are a data inversion function (described in the Description of the Related Art), and a function to convert a digital image signal from n bits into m bits ($m \geqq n$).

Because the materials differ for red (R), green (G), and blue (B) (abbreviated to 'RGB' hereinbelow) in an organic EL display device, favorable image quality can obtained by changing the color gradation-brightness characteristic minutely to match the Gamma characteristic.

FIG. 17 shows curves of inputted gradation data versus the desired brightness and serves the regulation of the brightness for each RGB color. In FIG. 17, the horizontal axis represents the inputted gradation data and the vertical axis represents the brightness.

FIG. 18 provides a detailed view of the data conversion circuit 16. The data conversion circuit 16 comprises latch circuits 35, which possess a holding function and a data inversion function, conversion tables for each color of RGB (36, 37, 38), and buffer circuits 39 for driving a data bus.

FIG. 19 represents an example in which a 6-bit image signal is converted into an 8-bit image signal.

The conversion table can be changed for each display model with RAM, ROM (EEPROM or the like), and so forth. Further, the data conversion table may comprise a table for correcting variations in the current value due to the temperature of a current driver circuit A 14 (described subsequently), whereby a high-quality display can be obtained by performing RGB brightness correction and temperature correction on the inputted digital image signal. In cases where high image quality is not a necessity, the conversion table may be excluded. Further, in cases where low electrical power consumption is not a necessity, the data inversion function may be discarded.

Referencing FIG. 1, a switching circuit B 10, shift register circuit 11, data register circuit 12, and data latch circuit 13, which constitute an expansion hold circuit that expands and holds serially inputted digital image signals in parallel, will be described.

When the horizontal start signal STH is inputted, sampling signals SPn (n=1, 2, 3, . . . ), which are synchronized with the clock signal, are generated in order by the shift register circuit 11. The shift register circuit 11 is constituted by a plurality of flip-flop circuits (abbreviated to 'FF circuits' hereinbelow)

(11*a* to 11*d*). The shift register circuit 11 is a bidirectional shift register with a reset function.

FIGS. 3A to 3D provide detailed views of the shift register circuit 11 and switching circuit B 10.

The switching circuit B 10 is constituted by a plurality of switches (10*a* to 10*d*) that are controlled by a switching control circuit 17. The input position of the horizontal start signal STH is switched and the order in which the sampling signals SPn are generated are changed.

A detailed description of the operation will be provided next.

Figure 3A:
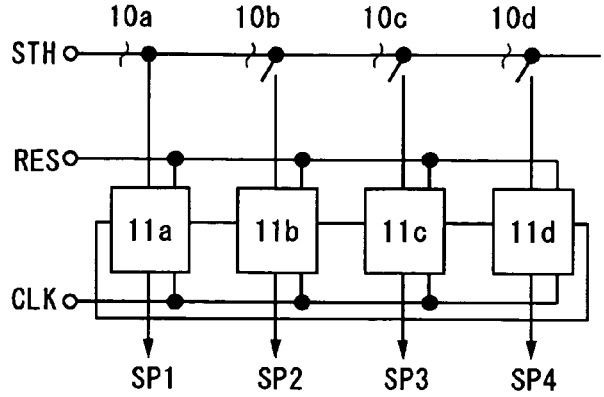
FIGS. 3A to 3D provide detailed views of a switching circuit B and shift register circuit of the first embodiment of the present invention.

When a switch 10*a* of the switching circuit B 10 is turned ON as shown in FIG. 3A, a sampling signal SP1 is generated by the FF circuit 11*a*, a sampling signal SP2 is generated by the FF circuit 11*b*, a sampling signal SP3 is generated by the FF circuit 11*c*, and a sampling signal SP4 is generated by the FF circuit 11*d* (a start signal is inputted and SP1 is initially generated, followed by SP2, SP3, and then SP4, . . . in this order).

Figure 3B:
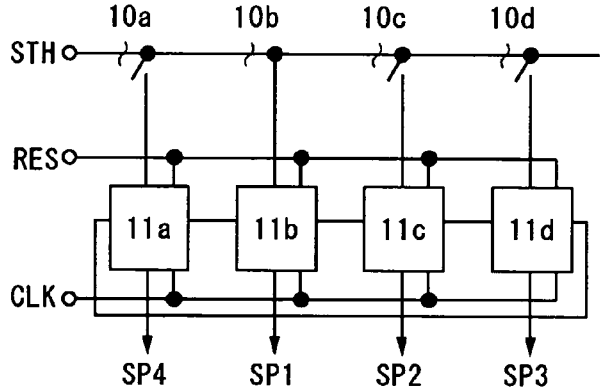

Next, when switch 10*b* is turned ON as shown in FIG. 3B, a sampling signal SP1 is generated by the FF circuit 11*b*, a sampling signal SP2 is generated by the FF circuit 11*c*, a sampling signal SP3 is generated by the FF circuit 11*d*, and a sampling signal SP4 is generated by the FF circuit 11*a*.

Figure 3C:
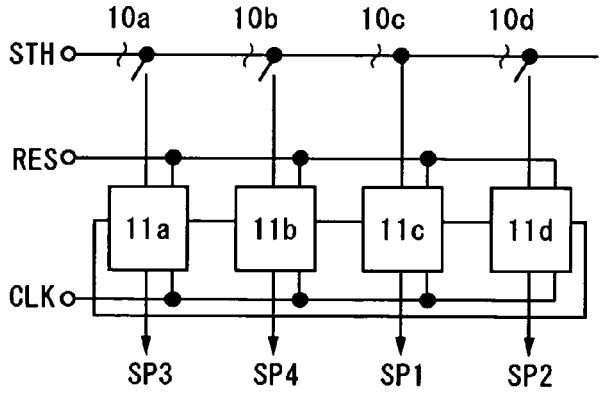
Figure 3D:
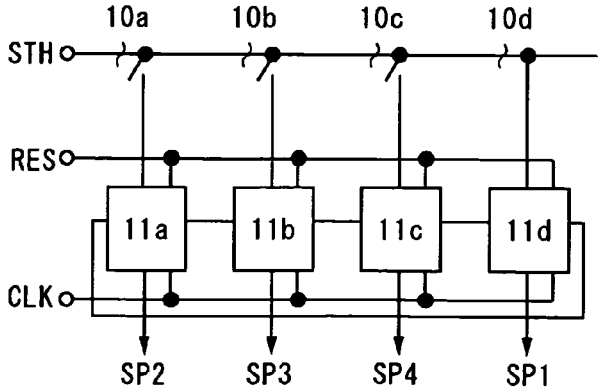

Similarly thereafter, sampling signals SPn, which correspond with the switch states of the switching circuit B as shown in FIGS. 3C and 3D, are generated. Further, the shift register circuit 11 is reset either when the final sampling signal has been generated or reset directly before the start signal is inputted. Further, although four FF circuits and four switches 10 are shown in FIGS. 3A to 3D, the present invention is not limited to four circuits and switches, five or more thereof being equally possible.

A digital image signal, which is serially inputted in sync with a clock signal, is converted into a predetermined digital image signal by the data conversion circuit 16 and held by a data register circuit 12 in the order of the sampling signals SPn. When the latch signal STB is inputted, digital image signals held by the data register circuit 12 are held altogether by the data latch circuit 13.

Figure 26A:
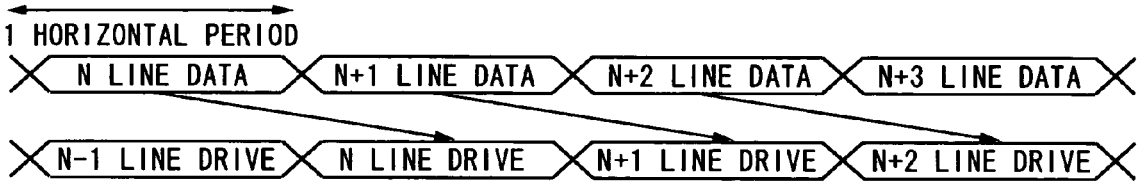
FIGS. 26A and 26B are timing charts of the display device of the present invention.
Figure 26B:
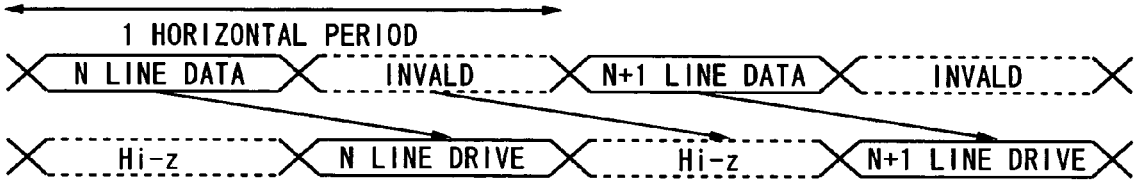
Figure 27:
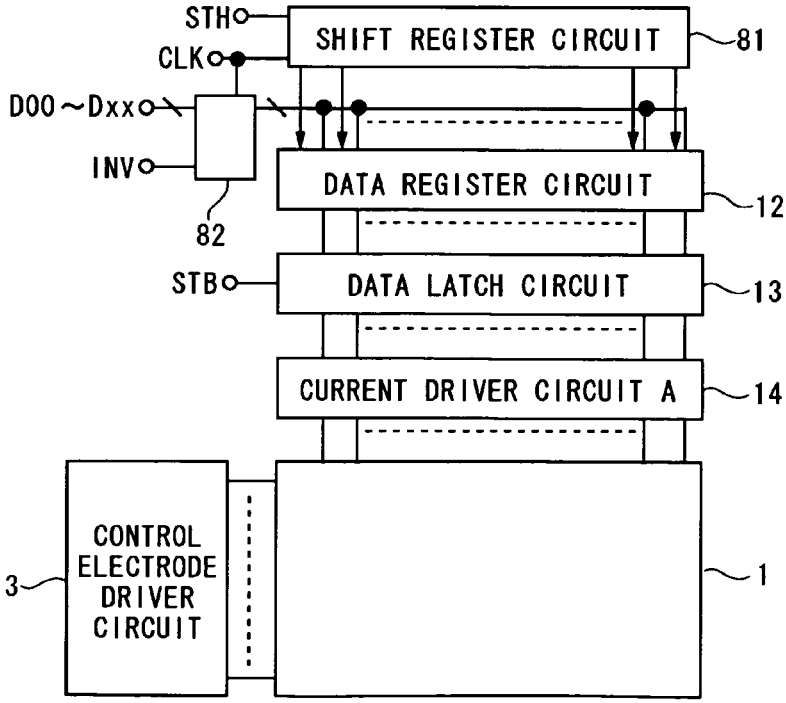
FIG. 27 is a data electrode driver circuit that is employed by the prior art.
Figure 28:
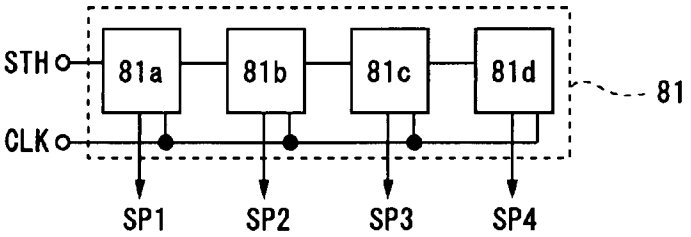
FIG. 28 is a shift register circuit that is employed by the prior art.

Here, although the timing of the data latch is generally executed as shown in FIG. 26A, by dividing, as shown in FIG. 26B, is divided into a data input period and a data electrode drive period, the data latch circuit 13 can also be eliminated. In this case, the level shift circuit is connected to the output of the data register circuit. Further, the level shift circuit for converting the voltage is not required when the logic-system supply voltage and drive-system supply voltage are the same.

The current driver circuit A 14 will be described next.

Figure 4:
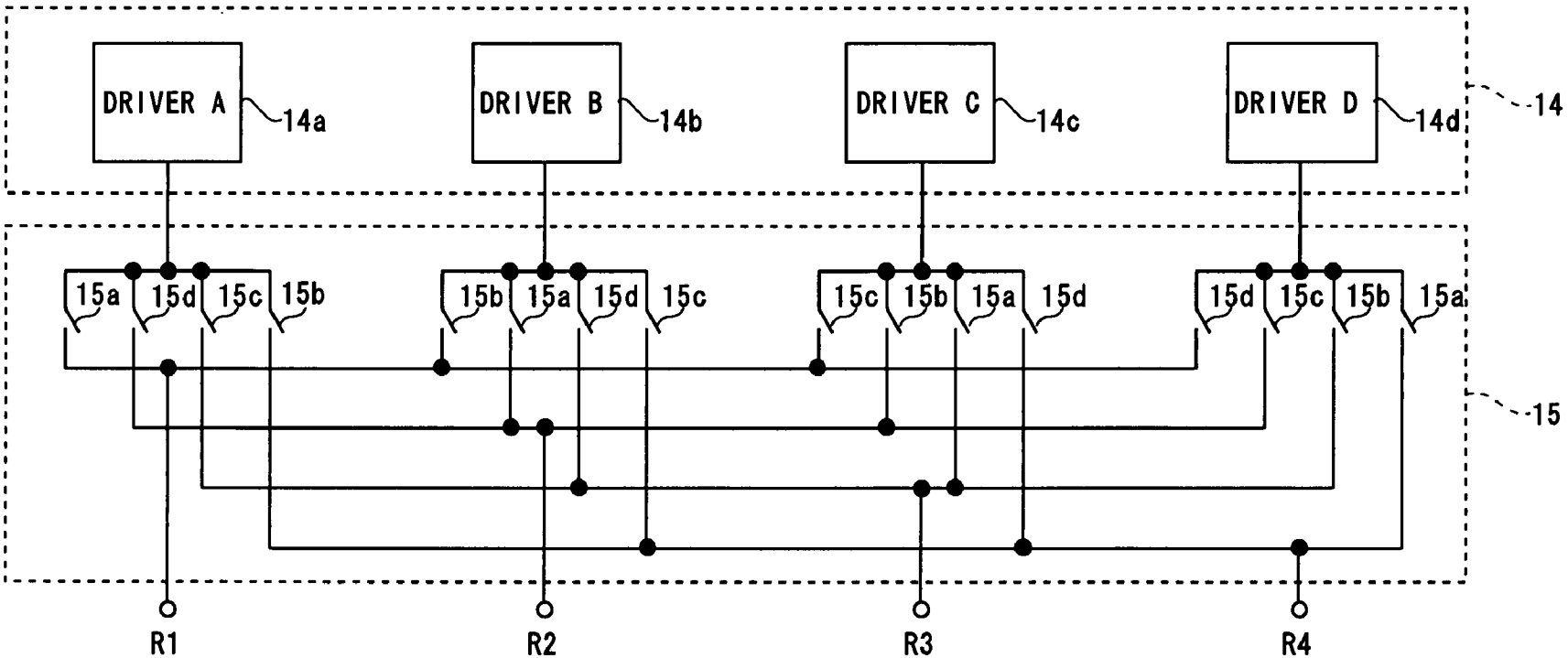
FIG. 4 provides a detailed view of a switching circuit A of the first embodiment of the present invention.
Figure 5A:
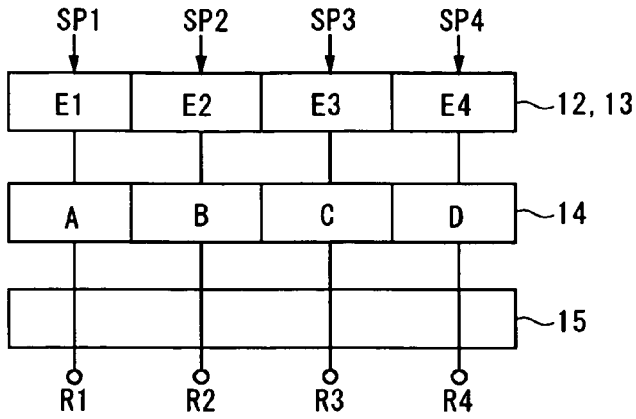
FIGS. 5A to 5D are usage examples of the switching circuit A of the first embodiment of the present invention.
Figure 5B:
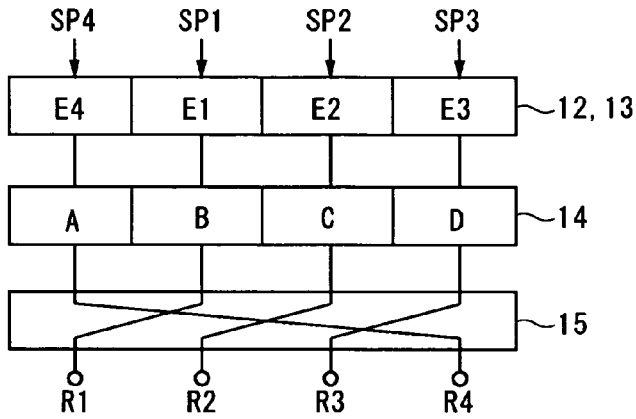
Figure 5C:
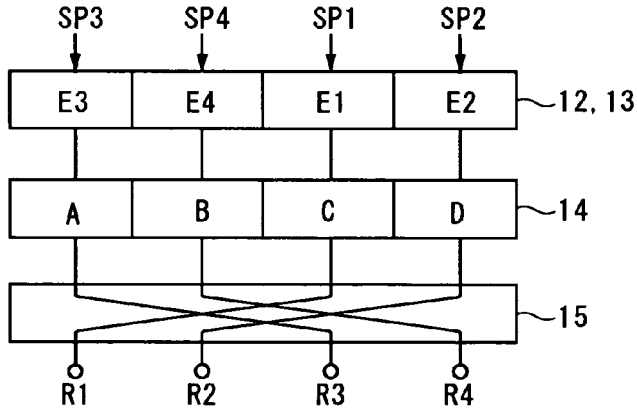
Figure 5D:
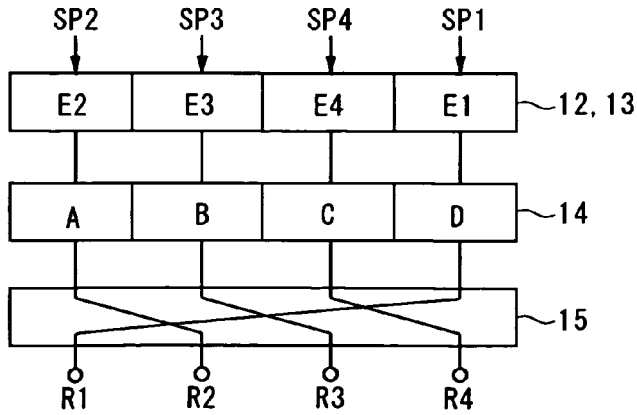
Figure 29:
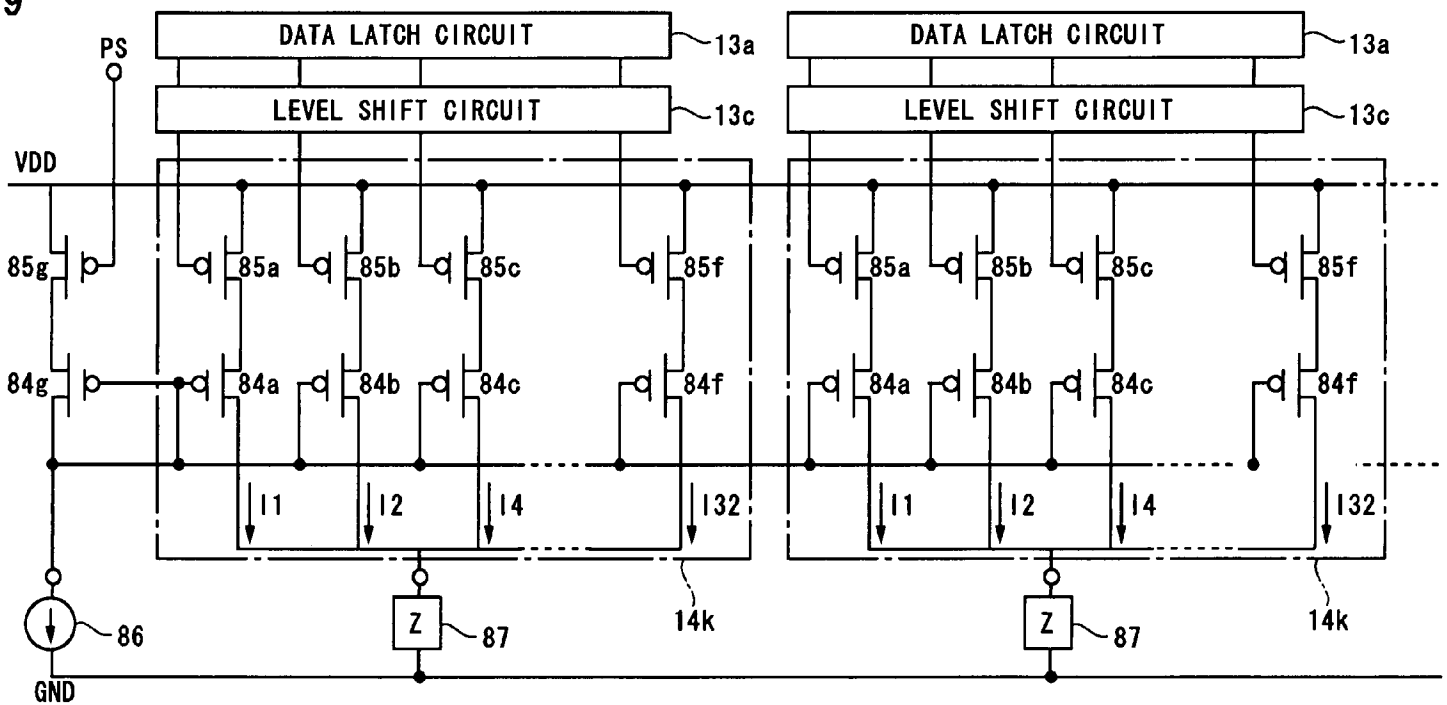
FIG. 29 is a current driver circuit that is employed by the prior art.

The current driver circuit A 14 is a circuit for converting a digital signal to an analog current value (abbreviated to 'D/I conversion circuit' hereinbelow. The D/A conversion circuit is defined and classified as a circuit for converting a digital signal into a voltage analog signal or current analog signal) and drives the data electrodes or other current drivers. The current driver circuit A 14 is constituted by a plurality of current drivers (14*a* to 14*d*) as shown in FIG. 4 and comprises a plurality of transistors that are weighted with current values such as those shown in the current driver 14*k* in FIG. 29.

Here, a description will be provided for a case where the number of bit m of the image signal is six (m=6).

As described in the Description of the Related Art, the Tr 85*a* to Tr 85*f* operate as switches and perform control in accordance with the image signal. Tr 84*a* to Tr 84*f* are fixed current devices that set current values that are weighted with respect to the current value I of the reference current device 86, and implement the current driver 14*k* for generating the current values of 64 levels. When weighted with a multiple of two, the current values in the order Tr 84*a*, Tr 84*b*, Tr 84*c*, Tr 84*d*, Tr 84*e*, and Tr 84*f* are set to 1×I, 2×I, 4×I, 8×I, 16×I, and 32×I. If, for example, the image signal is 000000, Tr 85*a* to Tr 85*f* are all OFF and current does not flow to the load 87 and, if the image signal is 111111, Tr 85*a* to Tr 85*f* are all ON and a current of 63×I then flows to the load 87.

Further, although a case where the number of bit m of the image signal is six (m=6) was described here, m may be 5 or less or 7 or more. Further, the current driver circuit A 14 may be a circuit other than that appearing in FIG. 29. For example, because the current driver circuit A 14 is constituted by p-type enhancement-type transistors in FIG. 29, the current driver is a discharge-type current driver. However, if the current driver circuit A 14 is constituted by n-type transistors, the current driver is a suction-type current driver. In addition, if transistors corresponding to transistors Tr 85*a* to Tr 85*f* are n-type transistors and the gate voltage range of the transistors is controlled to within the range of the logic voltage, the level shift register 13*b* can be discarded. Further, the circular symbol of a transistor gate electrode signifies inversion and signifies here that a transistor is turned ON by logic level '0'. Further, the transistor Tr 84 may be a depletion-type transistor, an enhancement-type transistor, or a bipolar-type transistor.

Figure 25A:
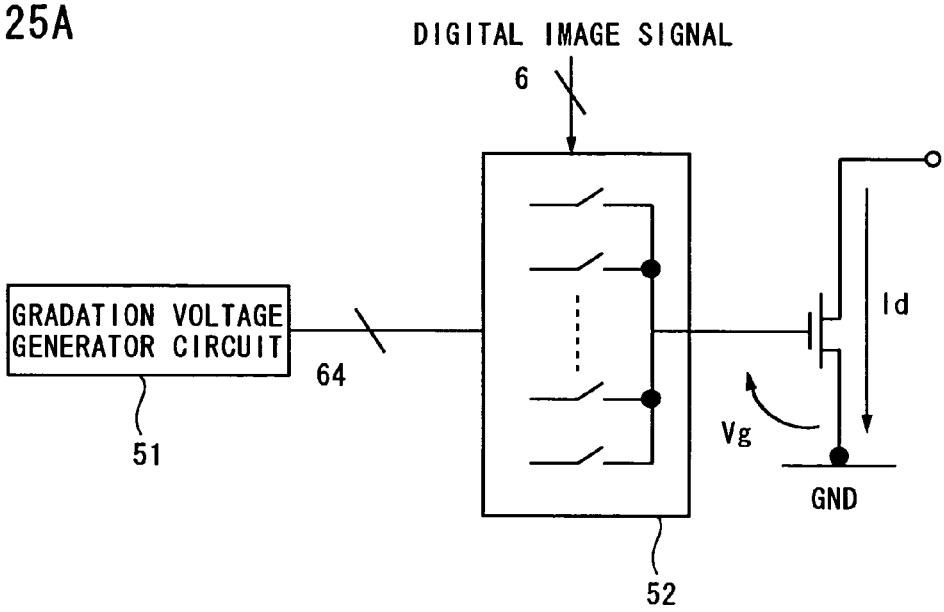
FIG. 25A is a current driver circuit with a Gamma conversion function that is used by the present invention.
Figure 25B:
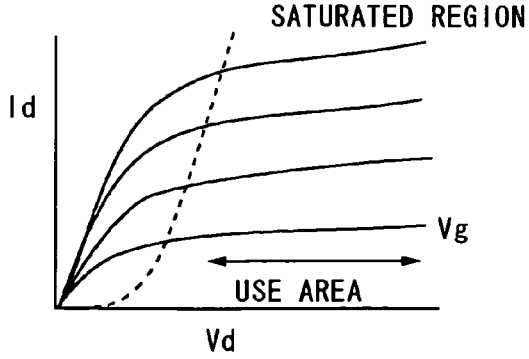
FIG. 25B is a curve input voltage versus output current of a transistor in FIG. 25A.

As another example, as shown in FIG. 25, one driver may be constituted by one transistor, a gradation current may also be generated by selecting one value, in accordance with the image signal, from a plurality of voltages that are preset so that the generated current value matches the Gamma characteristic and then applying this voltage to the gate electrode of the transistor.

Next, a description will be provided for a switching circuit A 15.

The switching circuit A 15 is a circuit that connects switch groups (15*a* to 15*d*) to each output of a plurality of current drivers (14*a* to 14*d*) as shown in FIG. 4 and switches the current drivers.

R1, R2, R3, and R4 in FIG. 4 are data electrodes or input electrodes of another current driver.

The switch groups (15*a* to 15*d*) connected to each current driver are controlled by the switching control circuit 17 and perform control in sync with switching circuit B 10 so that the digital image signals correspond to data electrodes.

Next, a description will be provided for correspondence between the respective current drivers and electrodes in each of the switch states of the switching circuits A 15 and B 10 with reference to FIGS. 3A to 3D and FIGS. 4 and 5A to 5D.

When switches 10*a* and 15*a* are ON and the other switches are OFF (see FIGS. 3A and 5A), electrode R1 is driven by driver A, electrode R2 is driven by driver B, electrode R3 is driven by driver C, and electrode R4 is driven by driver D. Similarly, when switches 10*b* and 15*b* are ON and the other switches are OFF (see FIGS. 3B and 5B), electrode R1 is driven by driver B, electrode R2 is driven by driver C, electrode R3 is driven by driver D, and electrode R4 is driven by driver A. When switches 10*c* and 15*c* are ON and the other switches are OFF, (see FIGS. 3C and 5C), electrode R1 is driven by driver C, electrode R2 is driven by driver D, electrode R3 is driven by driver A, and electrode R4 is driven by driver B. When switches 10*d* and 15*d* are ON and the other switches are OFF, (see FIGS. 3D and 5D), electrode R1 is driven by driver D, electrode R2 is driven by driver A, electrode R3 is driven by driver B, and electrode R4 is driven by driver C. Electrode R1 is driven in the order driver A, B, C, then D. Electrode R2 is driven in the order driver B, C, D, then A. Electrode R3 is driven in the order driver C, D, A, then B. Electrode R4 is driven in the order driver D, A, B, and then C.

Switching the switches may be executed in frame cycles or may be executed in both line cycles and frame cycles. Switching may also be performed in random cycles.

Next, the switching control circuit 17 will be described.

The switching control circuit 17 is a circuit for controlling the switching circuit A 15 and switching circuit B 10, and comprises a function for switching in frame cycles, line cycles and frame cycles, or for switching regularly or randomly, and so forth.

E1, E2, . . . , and so forth, in FIGS. 5A to 5D are held m-bit digital image signals. These digital image signals are inputted in the order E1, E2, E3, then E4, . . . , and correspond with electrodes as follows: E1: electrode R1; E2: electrode R2; E3: electrode R3; and E4: electrode R4. Control is implemented such that the image signals and data electrodes correspond as per the switch states in FIGS. 3A and 5A, FIGS. 3B and 5B, FIGS. 3C and 5C, and FIGS. 3D and 5D respectively.

Signals inputted to the switching control circuit 17 are such that, in addition to the illustrated vertical synchronization signal Vsync signal, horizontal synchronization signals Hsync, and cycle signals rendered by further dividing Vsync and Hsync into a plurality of signals, and so forth are inputted and randomly combined signals can also be generated from these signals by the switching control circuit 17.

The image quality is improved by dispersing the characteristic variations of the current drivers in time and space as described above by switching the position in which the start signal is inputted to switch the order of the expanded digital image signals, which are serially inputted in sync with the clock signal, and by driving a plurality of data electrodes in rotation by means of one current driver.

The number of switches constituting the switching circuit B 10 can be implemented without increasing the circuit scale by 1/(number of bits×number of drivers) in comparison with a constitution in which a switching circuit is disposed on the input side of the driver disclosed in Japanese Unexamined Patent Application Publication No. 09-152850.

In this embodiment, one current driver may correspond with all the data electrodes of the display device or an optional number of data electrodes may be grouped and driver on a group to group basis.

Second Embodiment

Figure 7:
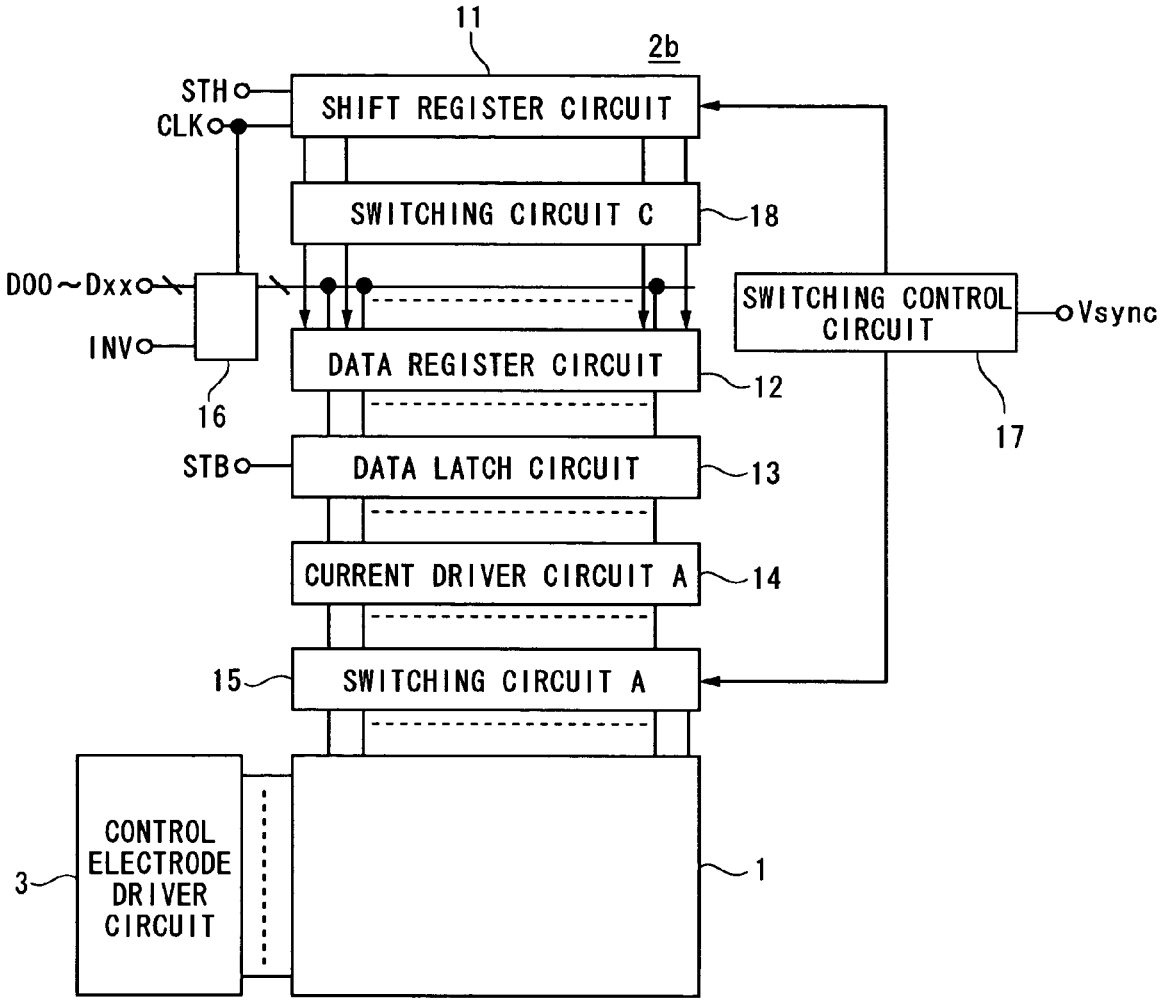
FIG. 7 is a data electrode driver circuit of a second embodiment of the present invention.

The second embodiment will be described with reference to FIG. 7.

A description of circuits that are the same as those in the first embodiment will be omitted in favor of a description of the differences.

A data electrode driver circuit 2*b* of this embodiment comprises a switching circuit C 18 between the shift register circuit 11 and data register circuit 12. Further, sampling signals SPn (n=1, 2, 3, . . . ), which are generated by the shift register circuit 11, are switched by the switching circuit C 18, the positions of expansion of digital image signals that are serially inputted in sync with clocks are switched, and the digital image signals are expanded and held by the data register circuit 12.

Figure 8A:
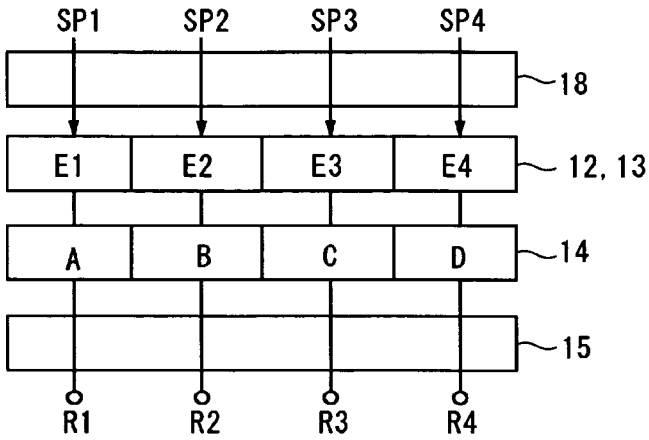
FIGS. 8A to 8D are block diagrams of a switching circuit C of the second embodiment of the present invention, and FIG. 8E provides a detailed view of the switching circuit C.
Figure 8B:
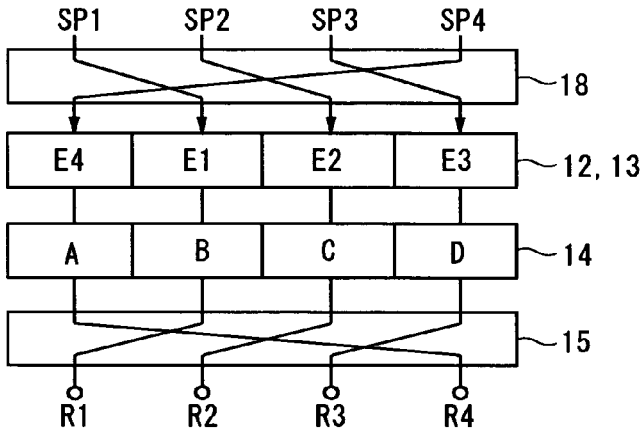
Figure 8C:
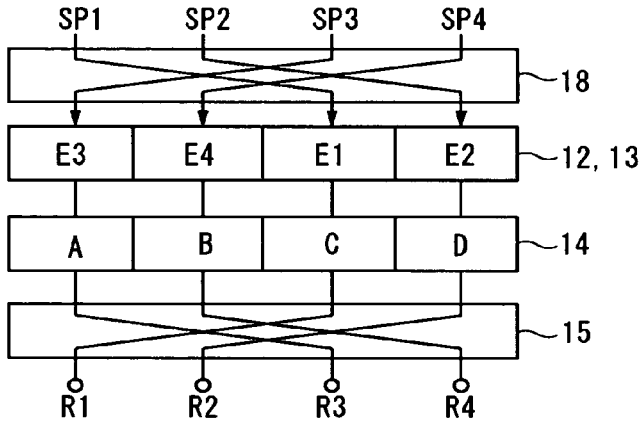
Figure 8D:
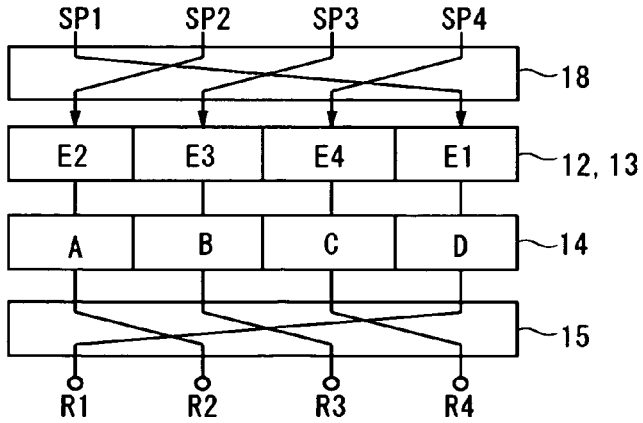
Figure 8E:
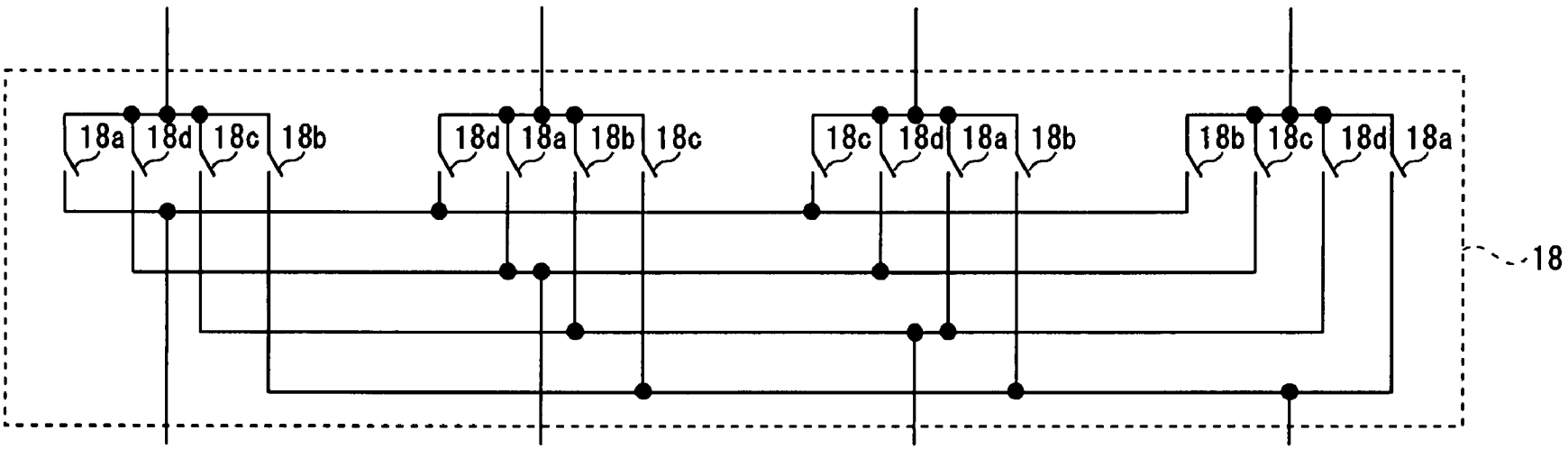

FIG. 8E shows the details of the switching circuit C.

The switching circuit C 18 is connected to the shift register circuit 11 and is constituted by a plurality of switch groups (18*a*, 18*b*, 18*c*, 18*d*, . . . ).

Next, FIGS. 8A, 8B, 8C, and 8D show switching examples for when there are four drivers.

FIG. 8A shows a state where switches 15*a* and 18*a* are ON and the other switches are OFF. Likewise, FIG. 8B shows a state where switches 15*b* and 18*b* are ON and the other switches are OFF. FIG. 8C shows a state where switches 15*c* and 18*c* are ON and the other switches are OFF. FIG. 8D shows a state where switches 15*d* and 18*d* are ON and the other switches are OFF.

The switching control circuit 17 controls switching circuits C and A and, when switching is performed in the order FIG. 8A, 8B, 8C, and then 8D, electrode R1 is driven in the order driver A, driver B, driver C, and then driver D. Electrode R2 is driven in the order driver B, driver C, driver D and then driver A. Electrode R3 is driven in the order driver C, driver D, driver A, and then driver B. Electrode R4 is driven in the order driver D, driver A, driver B, and then driver C.

Further, similarly to the first embodiment, the switching order may be in regular number order or in random number order. Further, the switching cycle may be executed in frame cycles or in both line cycles and frame cycles, or switching maybe in random cycles.

In the second embodiment, the number of switches can be implemented as 1/(number of bits) in comparison with a constitution in which switch circuits are disposed on the input side of the drivers by switching the sampling signal in the switching circuit C 18.

Although the number of switches is large in comparison with the first embodiment, because there is a larger number of combinations for randomly switching switches than in the first embodiment, uneven brightness on the screen can be further dispersed.

Third Embodiment

Although it was mentioned in the first embodiment that an optional number of data electrodes may be grouped and driver on a group to group basis. The groups preferably consist of the data electrodes corresponding to the same color.

Figure 20:
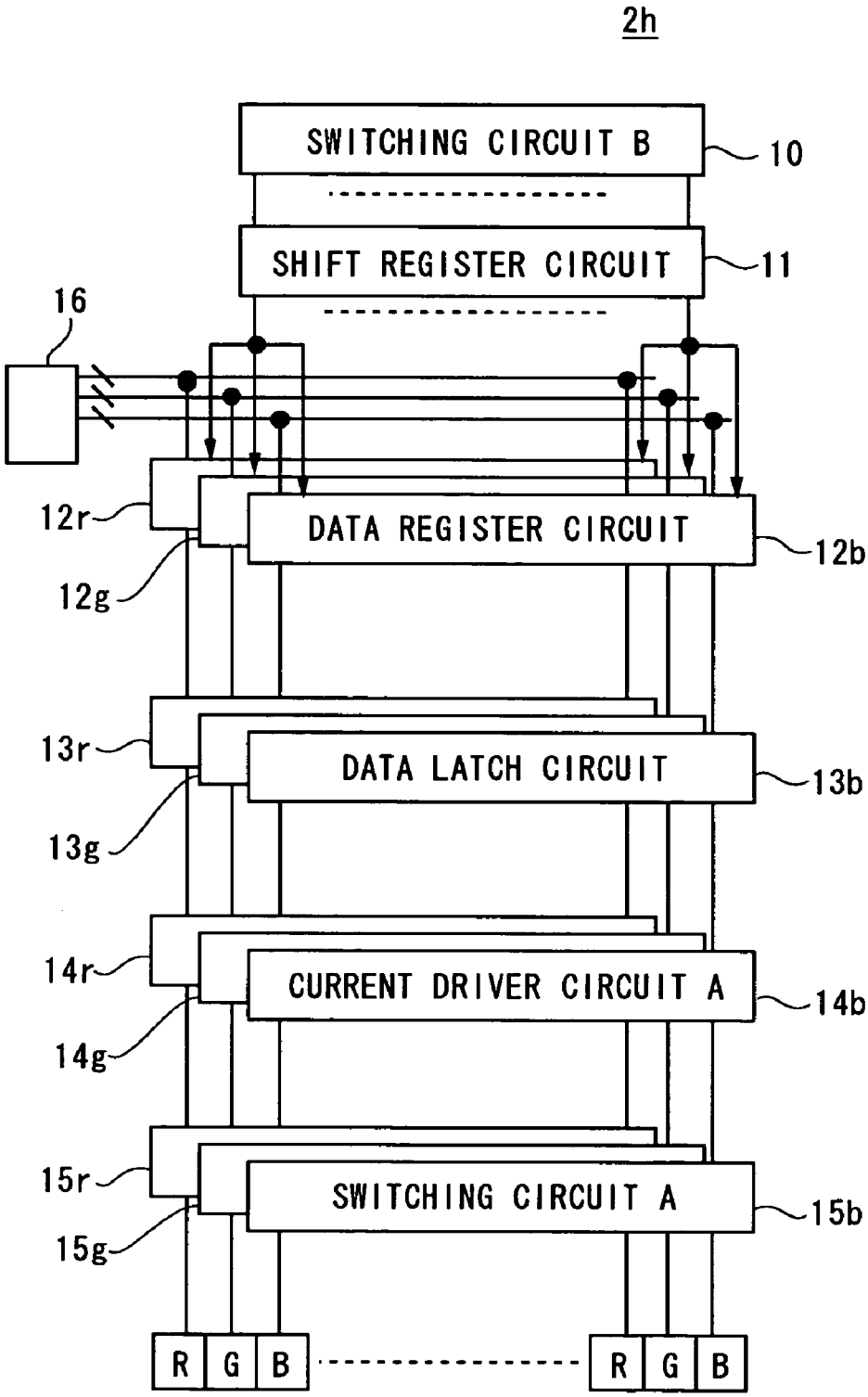
FIG. 20 is a data electrode driver circuit of the third embodiment of the present invention.

The driver circuits shown in FIG. 20 may be grouped for each color of RGB and switched within each of these groups. The display device shown in FIG. 20 comprises an R data register circuit 12*r*, a G data register circuit 12*g*, a B data register circuit 12*b*, an R data latch circuit 13*r*, a G data latch circuit 13*g*, a B data latch circuit 13*b*, an R current driver circuit A 14*r*, a G current driver circuit A 14*g*, a B current driver circuit A 14*b*, an R switching circuit A 15*r*, a G switching circuit A 15*g*, and a B switching circuit A 15*b*. The display device performs data shift and driver switching for each color. In FIG. 20, the switching control circuit, input signals, and so forth have been omitted because they are the same as those of FIG. 1. Likewise, the description the operation has been omitted because it is the same as that of the first embodiment.

Figure 21:
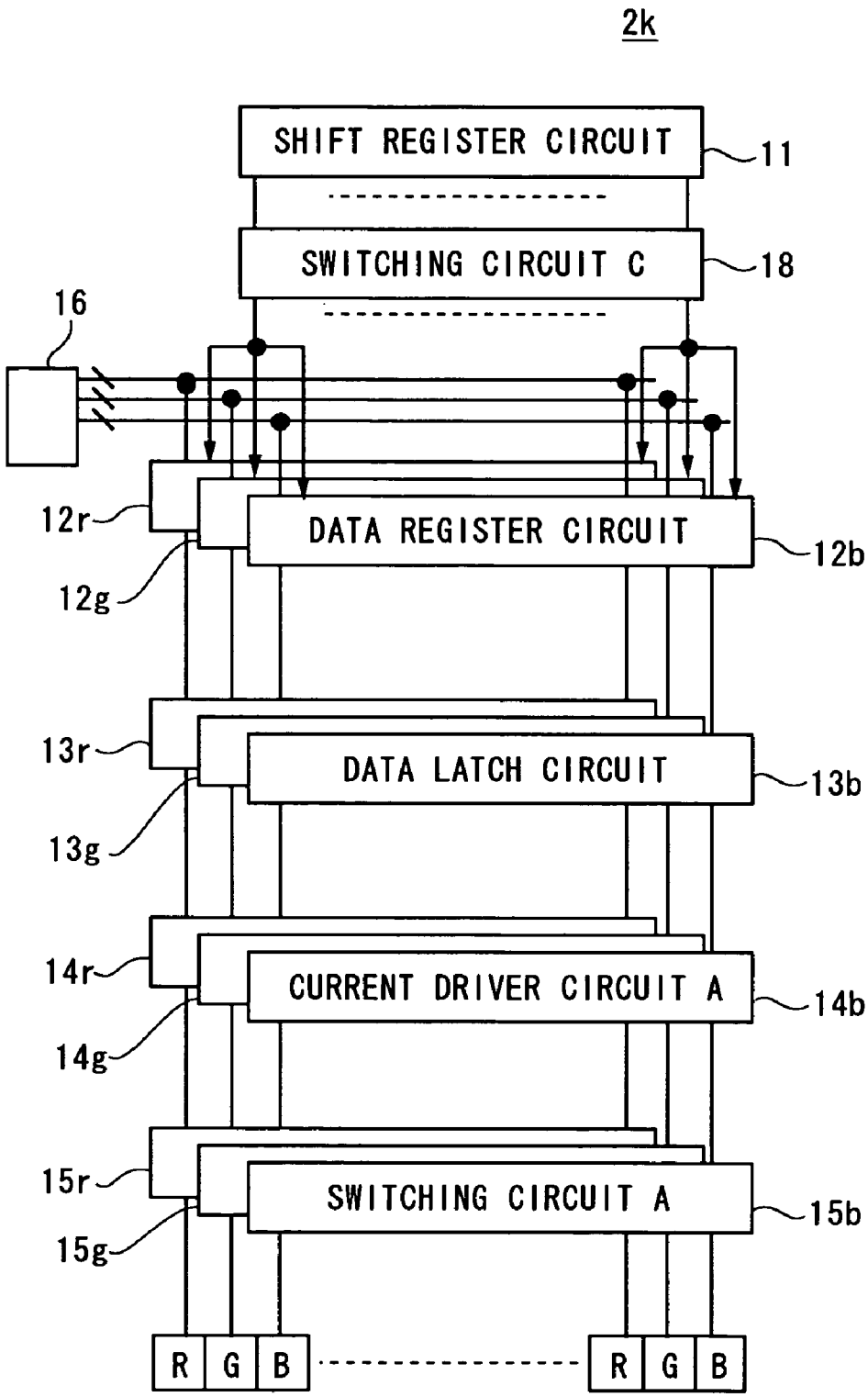
FIG. 21 is another data electrode driver circuit of the third embodiment of the present invention.
Figure 22:
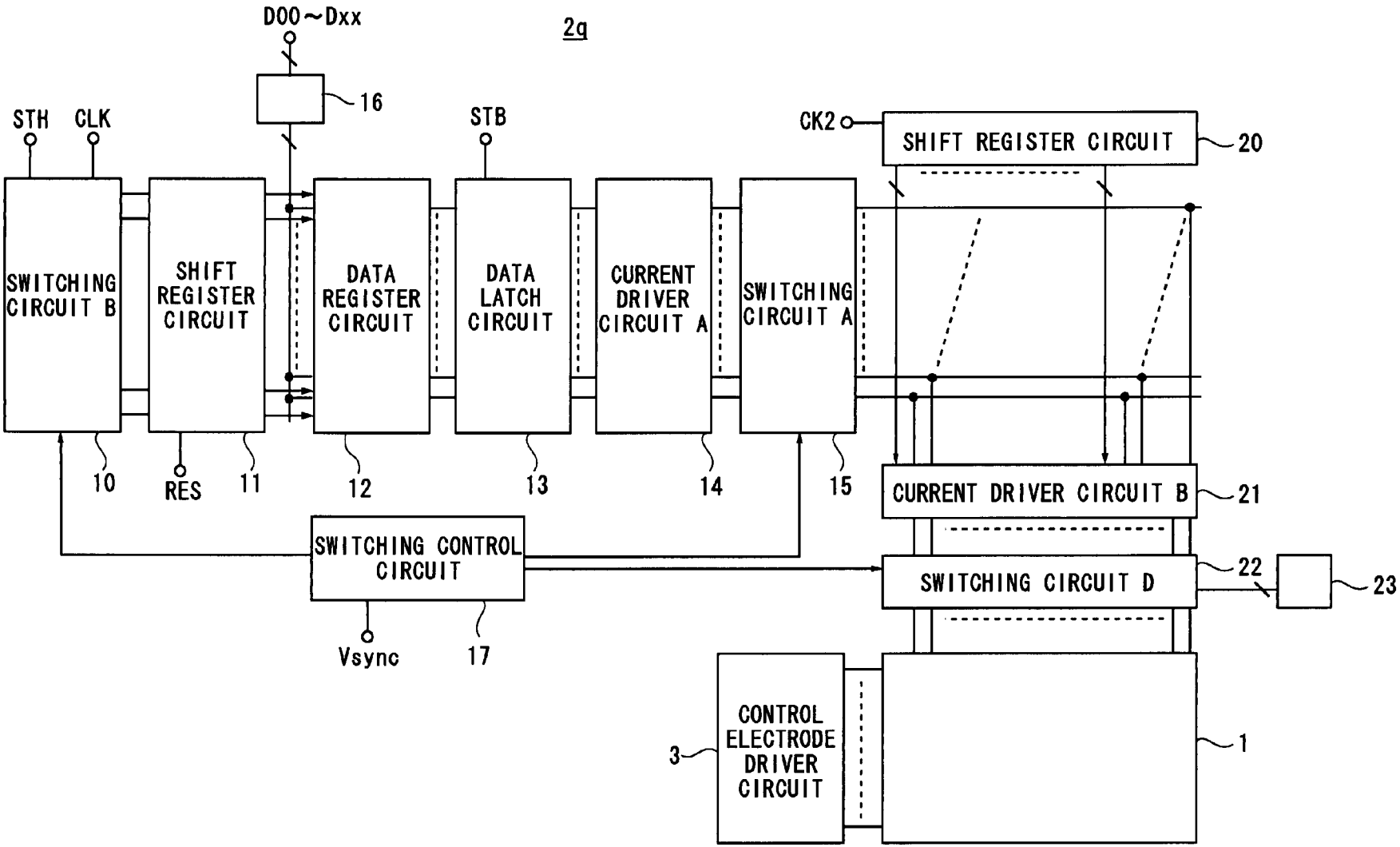
FIG. 22 is a data electrode driver circuit of another embodiment of the present invention.

Further, FIG. 21 shows driver circuits that are rendered by grouping the driver circuits (FIG. 2) described in the second embodiment according to RGB.

Similarly to FIG. 20 above, because the operation is the same as that of the first and second embodiments, FIG. 21 does not illustrate the operation.

In FIGS. 20 and 21, there are three groups of inputted digital image signal data buses for each RGB color. However, there may be six groups with two data buses for each RGB color or nine groups with three data buses for each RGB color. The number of groups may be a multiple of three.

By grouping according to RGB, because the number of switches of the switching circuit A can be reduced, the parasitic capacitance of the switching circuit A decreases and the electrical power consumption can be reduced.

Fourth Embodiment

Figure 9:
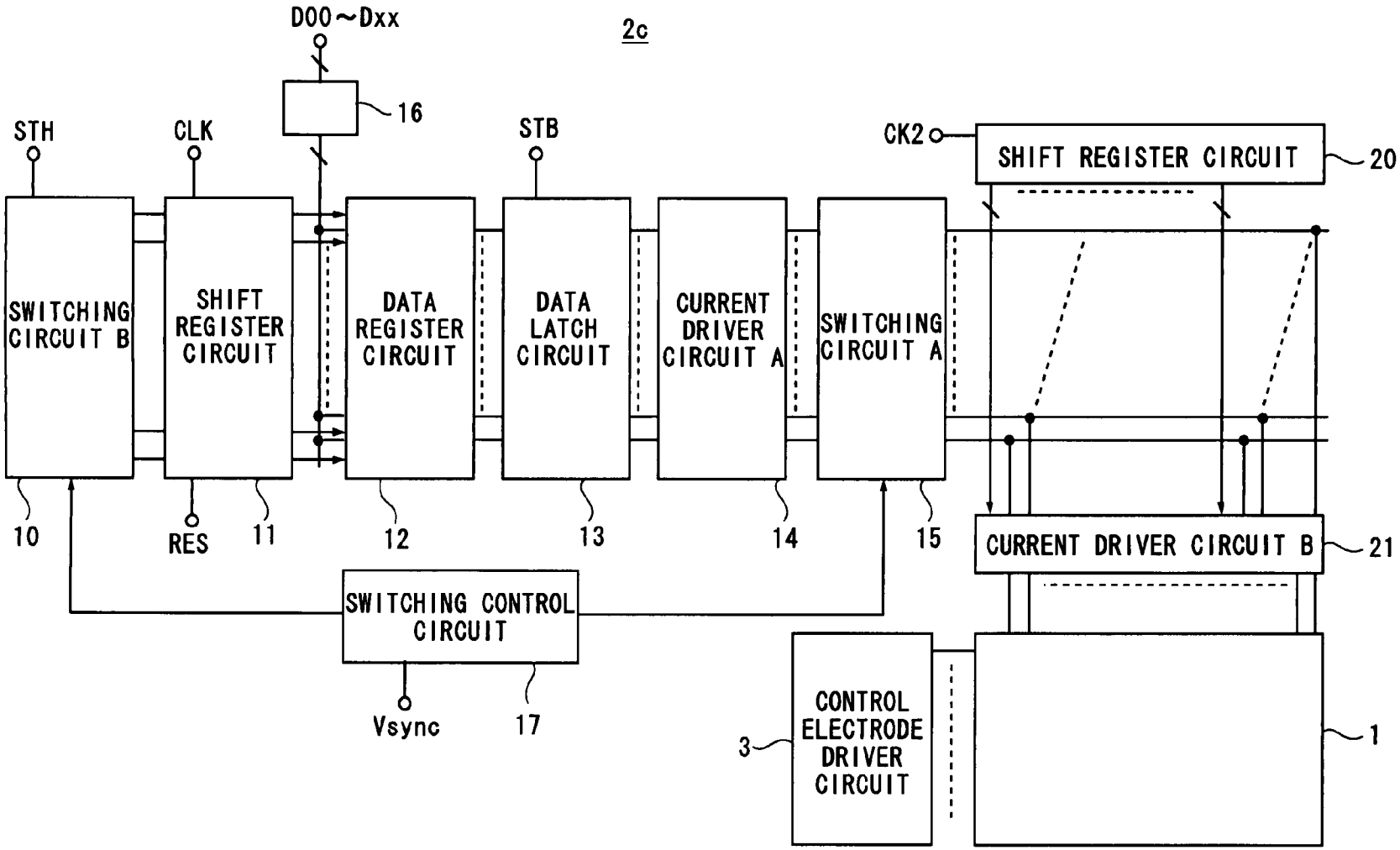
FIG. 9 is a data electrode driver circuit of a fourth embodiment of the present invention.

Although in the first embodiment, the switching circuit A is connected to the data electrodes, it is better to establish a connection with the current driver circuit B shown in FIG. 9 or another driver circuit. The parasitic capacitance of the data electrodes increases with an increasing number of pixels, and the parasitic capacitance of the switching circuit A increases with the number of switches in the switching circuit A. Further, the circuit scale of a circuit for converting a digital signal into an analog current value (abbreviated to 'D/I conversion' hereinbelow) is also magnified in accordance with an increase of the number of bit of the image signal, and therefore the better is smaller number of D/I conversion circuits. Therefore preferably the digital image signal is D/I converted, and a plurality of analog-input-type current drivers are driven by means of a single D/I converter.

While the current driver circuit A (constituted by a plurality of D/I converters) generates an analog-value gradation current in accordance with the digital image signal, the current driver circuit B receives an analog-value gradation current value and generates an analog-value current rendered by referencing the received current value.

Figure 10A:
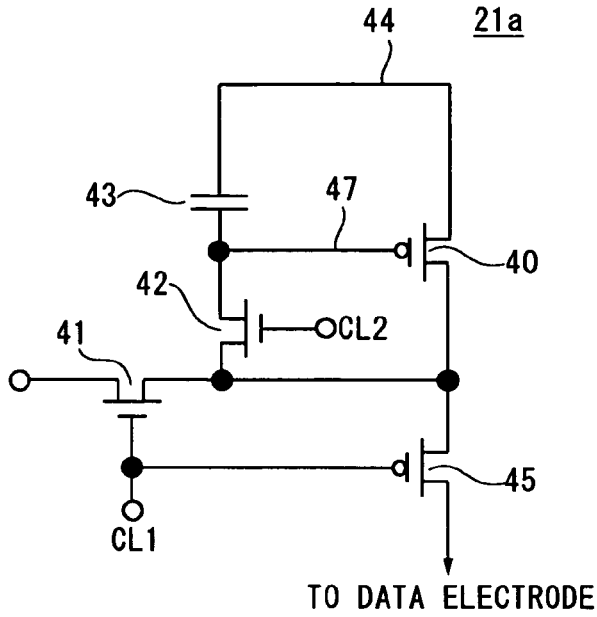
FIGS. 10A and 10B provide a detailed view of a current driver circuit B of the fourth embodiment of the present invention.
Figure 10B:
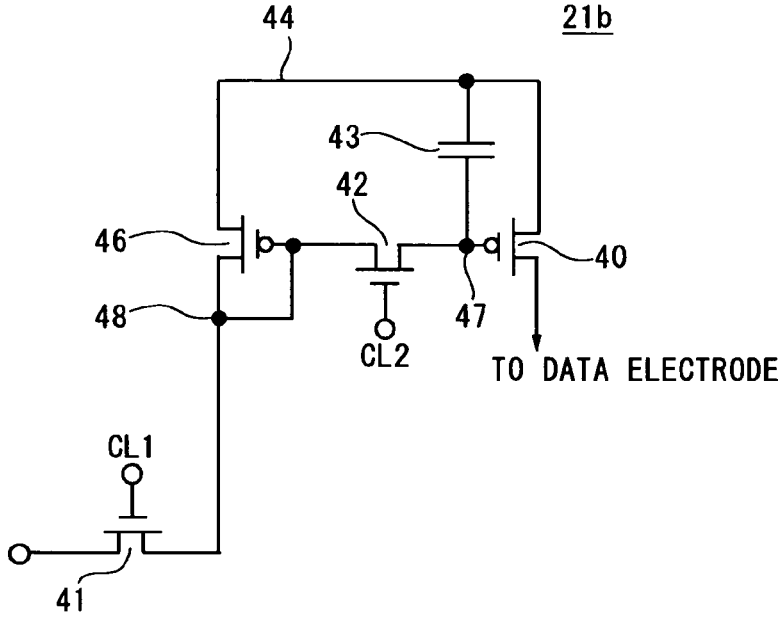
Figure 10C:
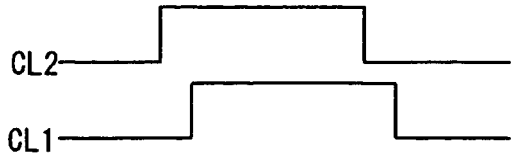
FIG. 10C is a timing chart.
Figure 11:
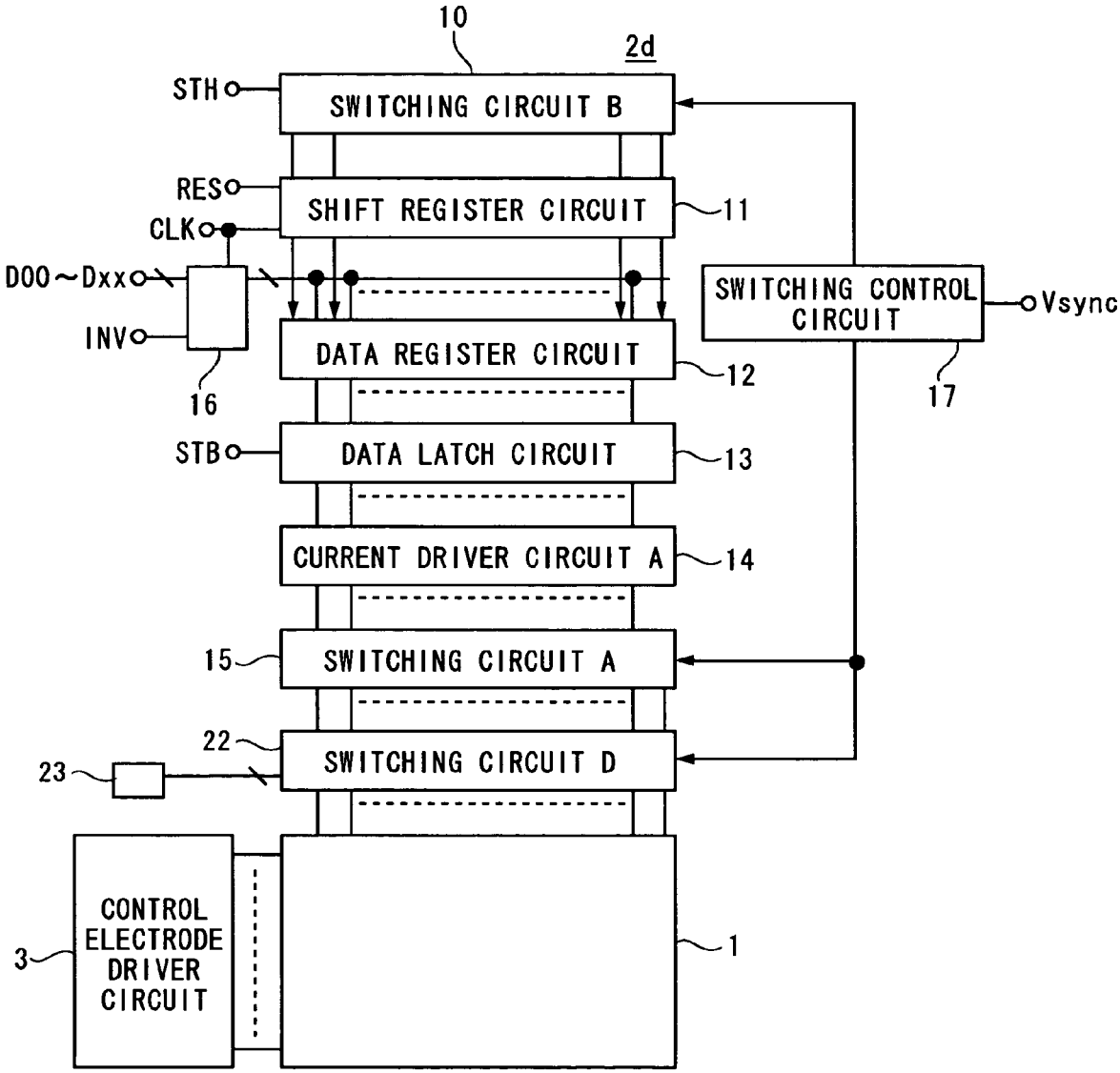
FIG. 11 is a data electrode driver circuit of a fifth embodiment of the present invention.

As an example of current driver circuit B, FIG. 10A shows a current copy-type current driver, FIG. 10B shows a current mirror-type current driver, and FIG. 10C shows a timing chart.

The operation of the current copy-type current driver shown in FIG. 10A will now be described.

When a current from the D/I converter is inputted to a source electrode of Tr 41 and signal CL1 passed to a gate electrode of Tr 41 and CL2 passed to gate electrodes of Tr 42 and Tr 45, are rendered "H", a current of the same value as that of the D/I converter flows to the drive Tr 40 via Tr 41 and the gate voltage of the drive Tr 40 at this time is sampled and held in gate electrode 47 by turning Tr 42 OFF.

Next, when Tr 41 is turned OFF and Tr 45 is turned ON, the data electrodes are driven via Tr 45 by the current flowing to the drive Tr 40. This current copy-type current driver possesses a small characteristic variation in comparison with the current mirror-type current driver that will be described subsequently.

Next, the operation of the current mirror-type current driver in FIG. 10B will be described.

When current from the D/I converter is inputted to the source of Tr 41 and signals CL1 and CL2 connected to the respective gate electrodes of Tr 41 and Tr 42 are rendered "H", a current of the same value as that of the D/I converter flows to Tr 46 via Tr 41; Tr 42 is then turned OFF and the gate voltage of Tr 46 is sampled and held by the gate electrode 47, and then Tr 41 is turned OFF.

Because Tr 46 and the drive Tr 40 have a current mirror constitution, a current corresponding to the current ratio between the Tr 46 and drive Tr 40 then flows to drive Tr 40 to drive the data electrodes. The current mirror-type current driver differs from the current copy-type current driver and can drive the data electrodes by means of a current with a different current value from the current value of the D/I converter. Typically, the value of the current flowing to the drive Tr 40 is made smaller than the value of the current flowing to Tr 46, whereby the electrical power consumed by the pixel circuit is reduced.

The present invention is not limited to the circuit diagrams shown in FIGS. 10A and 10B. A circuit to cancel the switching noise during sampling may be connected to the gate electrode 47. Further, a current copy-type current driver or current mirror-type current driver with another constitution may be employed.

Next, the optimum number of write processes in a single D/I conversion will be calculated.

For example, in the circuit in FIG. 1, the pixel number is QVGA (240×RGB×320), and hence the number of data electrodes is 720 and the number of control electrodes is 320, meaning that the current driver circuit A (a plurality of D/I converters) must drive the parasitic capacitance of the 720 switches of the switching circuit A and the parasitic capacitance of the 320 pixel circuits.

As an example, settings are made such that the parasitic capacitance of one switch of the switching circuit A is 0.01 pF, the parasitic capacitance of the pixel circuit is 0.1 pF, the parasitic capacitance of the current driver circuit B is 0.5 pF, and the drive voltage is 2V.

The number of pixels is QVGA and the parasitic capacitance of the data electrodes and switching circuit A is then 320×0.1 pF+720×0.01 pF=39.2 pF.

Next the minimum current value is calculated as follows. One horizontal period is approximately 50 μsec at a frame frequency of 60 Hz. Therefore, based on I=CV/t (C: capacitance value, V: voltage, t: drive time), the current value I=39.2 pF×2V/50 μsec=1.6 μA is the minimum current value.

In a case where a current driver circuit B 21 is a current copy-type current driver circuit and there are three write processes, the time required to write to the third data electrode may be t=320×0.1 pF×2V/1.6 μA=40 μsec.

The parasitic capacitance as viewed from the D/I converter is 'the parasitic capacitance of the current driver circuit B+parasitic capacitance of the switching circuit A', i.e. the parasitic capacitance=3×0.5 pF+240×0.01 pF=3.9 pF. The time taken by the D/I converter to carry out the write process to the current driver circuit B up until the second write process is t=3.9 pF×2V/1.6 μA×2 times=9.75 μsec, and the remaining write time is as much as (50−9.75)=approximately 40 μsec. Therefore, the pixel circuits can be adequately written by the current driver circuit B.

The number of the present D/I converters is ⅓ of the number of the electrode and hence the electrical power consumed by the D/I converters is also ⅓.

When six write processes are performed, the current driver circuit B corresponds to the current mirror-type driver shown in FIG. 10B.

Further, the parasitic capacitance as viewed from the D/I converter is then 6×0.5 pF+120×0.01 pF=4.2 pF and the current value for driving the data electrodes is the same at 1.6 μA. In order to make the time required up until the fifth write process 10 μsec, I=CV/t=4.2 pF×2V/10 μsec×five times=4.2 μA.

That is, settings are made so that the current ratio between Tr 46 and drive Tr 40 is 4.2:1.6.

Further, although the current consumed by one D/I converter increases approximately 2.6-fold, the current value consumed by the whole of current driver circuit A is ⅙-fold, and hence the current value consumed by the current driver circuit A becomes approximately 0.44-fold.

The number of the current devices driven by one D/I converter is decided whether three or six write processes are to be executed, or another write frequency is to be used, which depends on a parameter among parameters such as the electrical power consumption of the whole display device, the circuit scale, and the display quality are to be prioritized.

Fifth Embodiment

FIGS. 11 and 12A to 12E represent an example in which a switching circuit D 22 is connected to the switching circuit A 15 in FIGS. 1 and 2 in order that a plurality of data electrodes be driven by one current driver by means of time division.

Figure 12A:
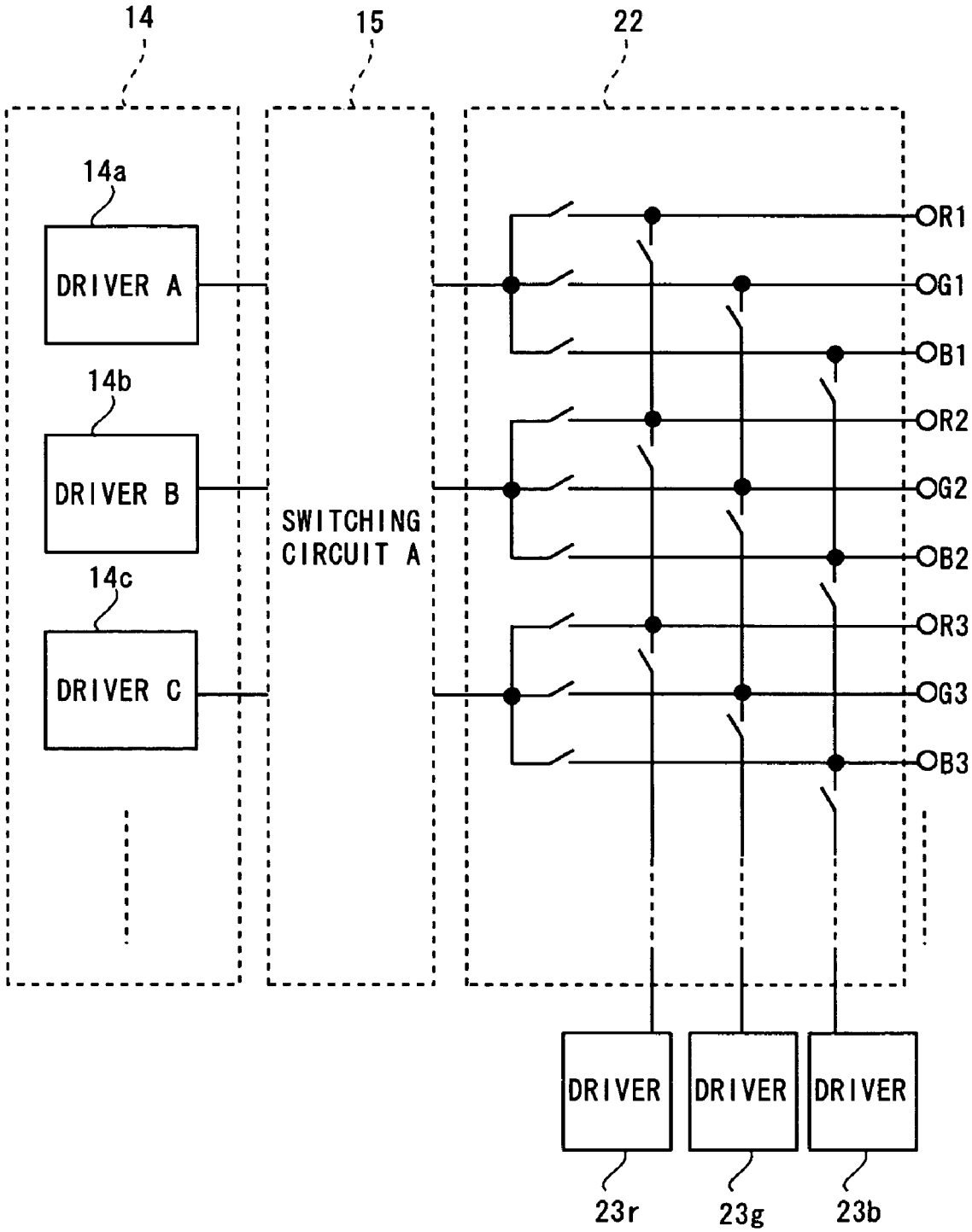
FIGS. 12A to 12E provide detailed views of a switching circuit D of the fifth embodiment of the present invention.
Figure 12B:
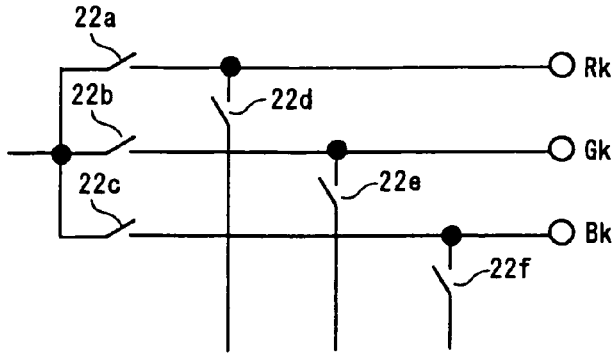

FIG. 12A provides a detailed view of the switching circuit D 22.

A switch 22*a* is connected to data electrode Rk (k: 1, 2, 3, . . . ), a switch 22*b* is connected to data electrode Gk (k: 1, 2, 3, . . . ), and a switch 22*c* is connected to data electrode Bk (k: 1, 2, 3, . . . ). Further, switches 22*d*, 22*e*, and 22*f* for selecting a non-light-emission level voltage are connected to each data electrode.

The operation will be described next.

First, time division that divides a single frame into a plurality of at least four or more subframe periods is preferable.

Figure 13:
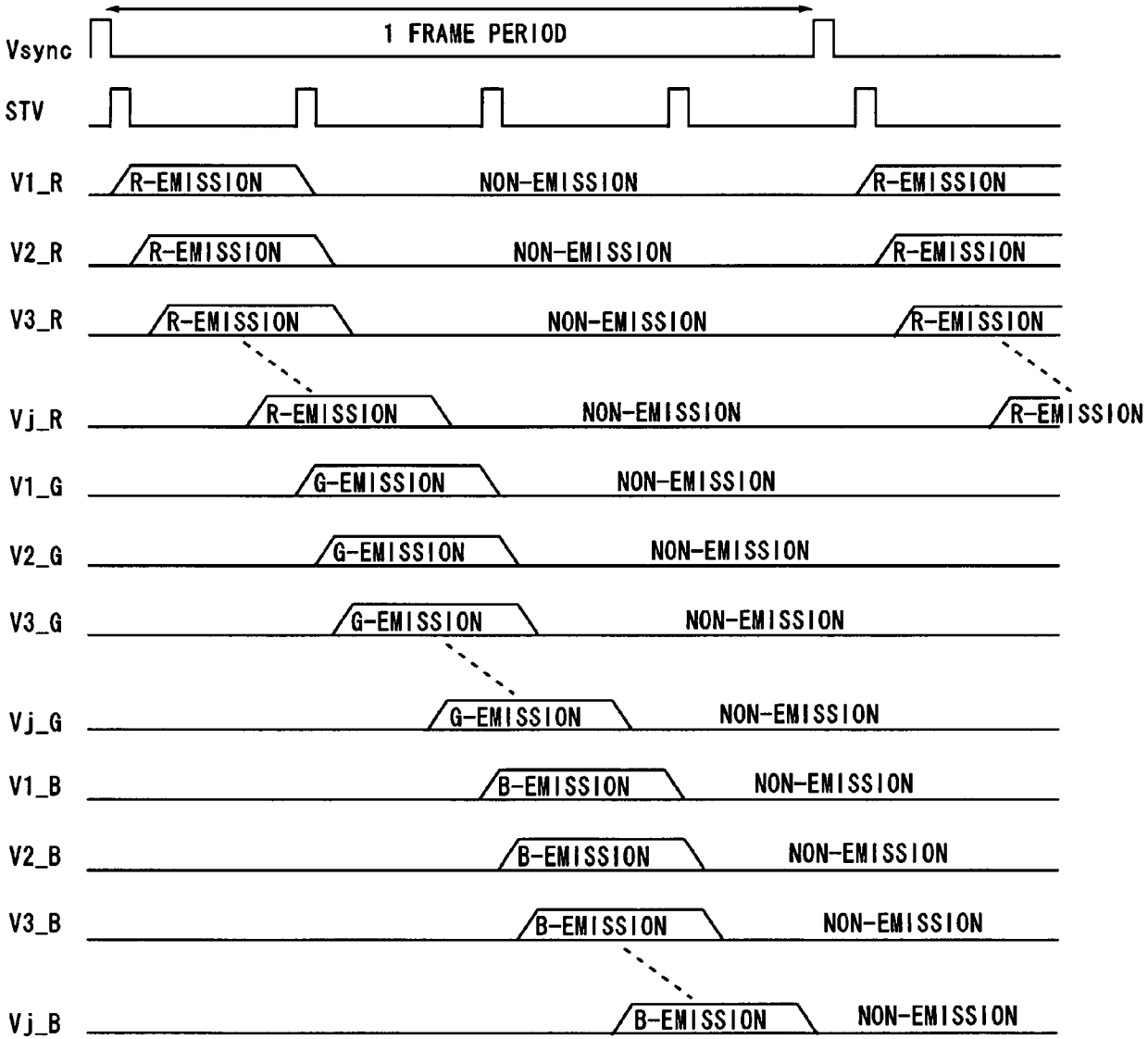
FIG. 13 is a timing chart of the display device of the fifth embodiment of the present invention.
Figure 14:
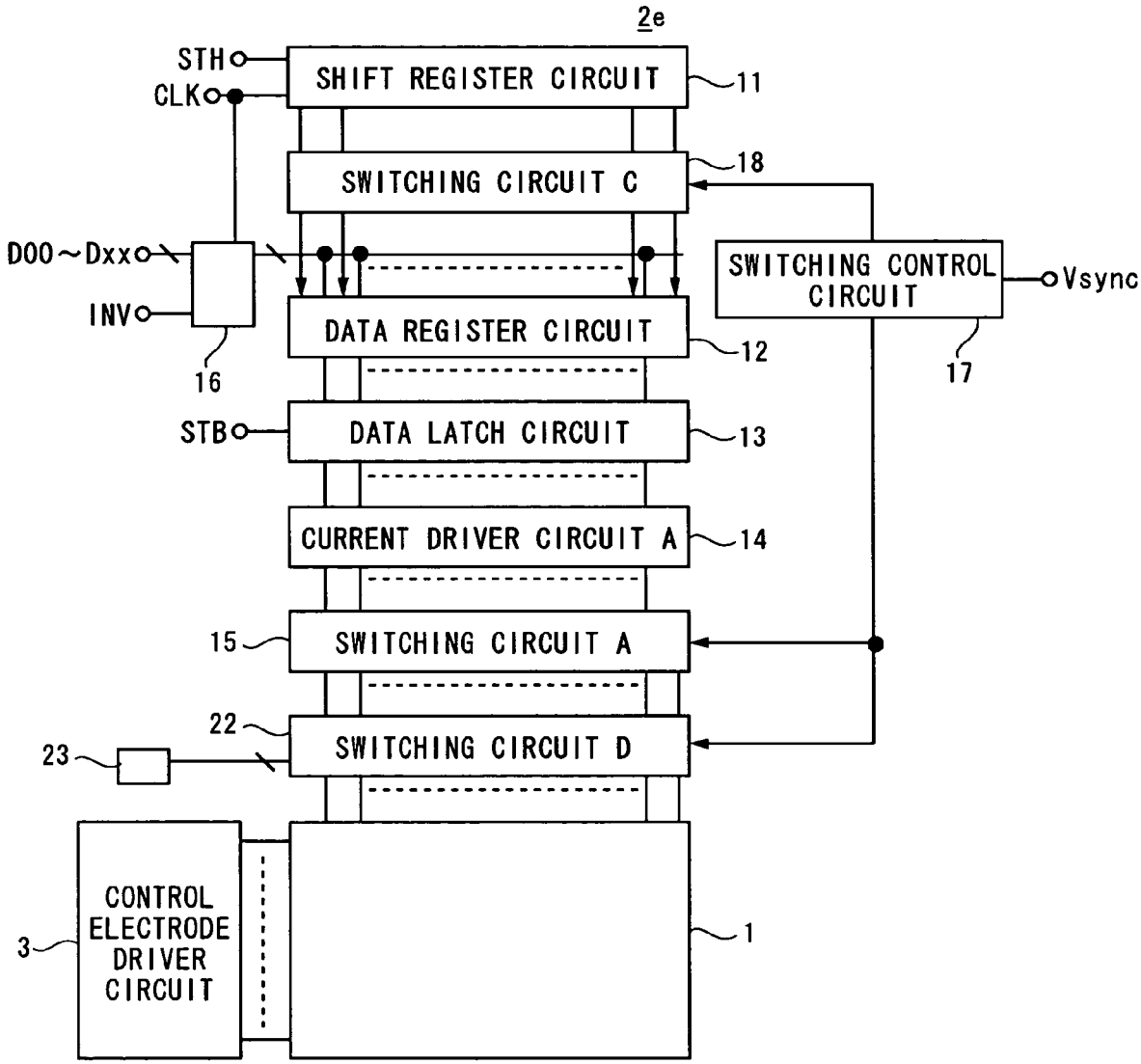
FIG. 14 is another data electrode driver circuit of the fifth embodiment of the present invention.
Figure 15:
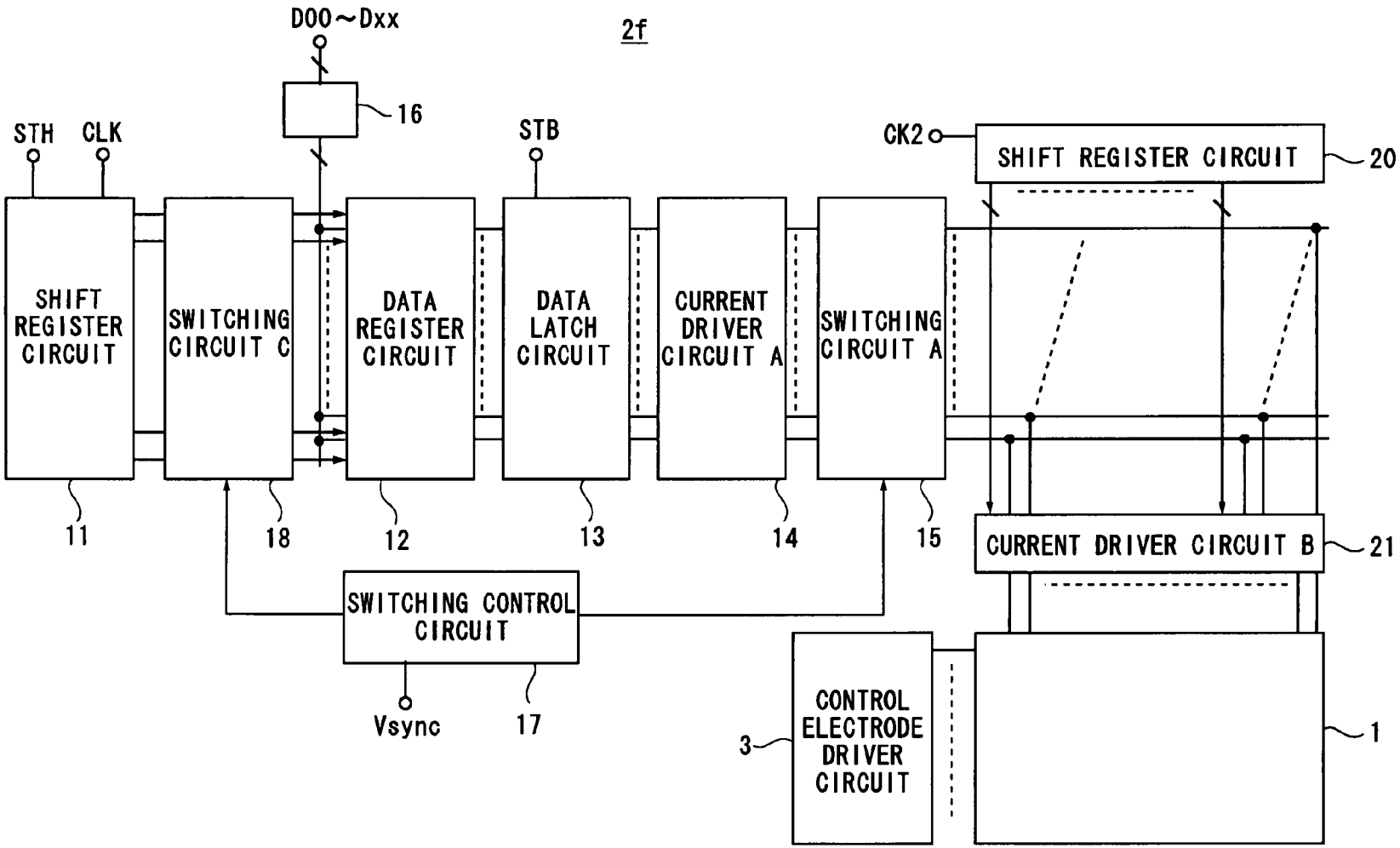
FIG. 15 is a data electrode driver circuit of another embodiment of the present invention.
Figure 16:
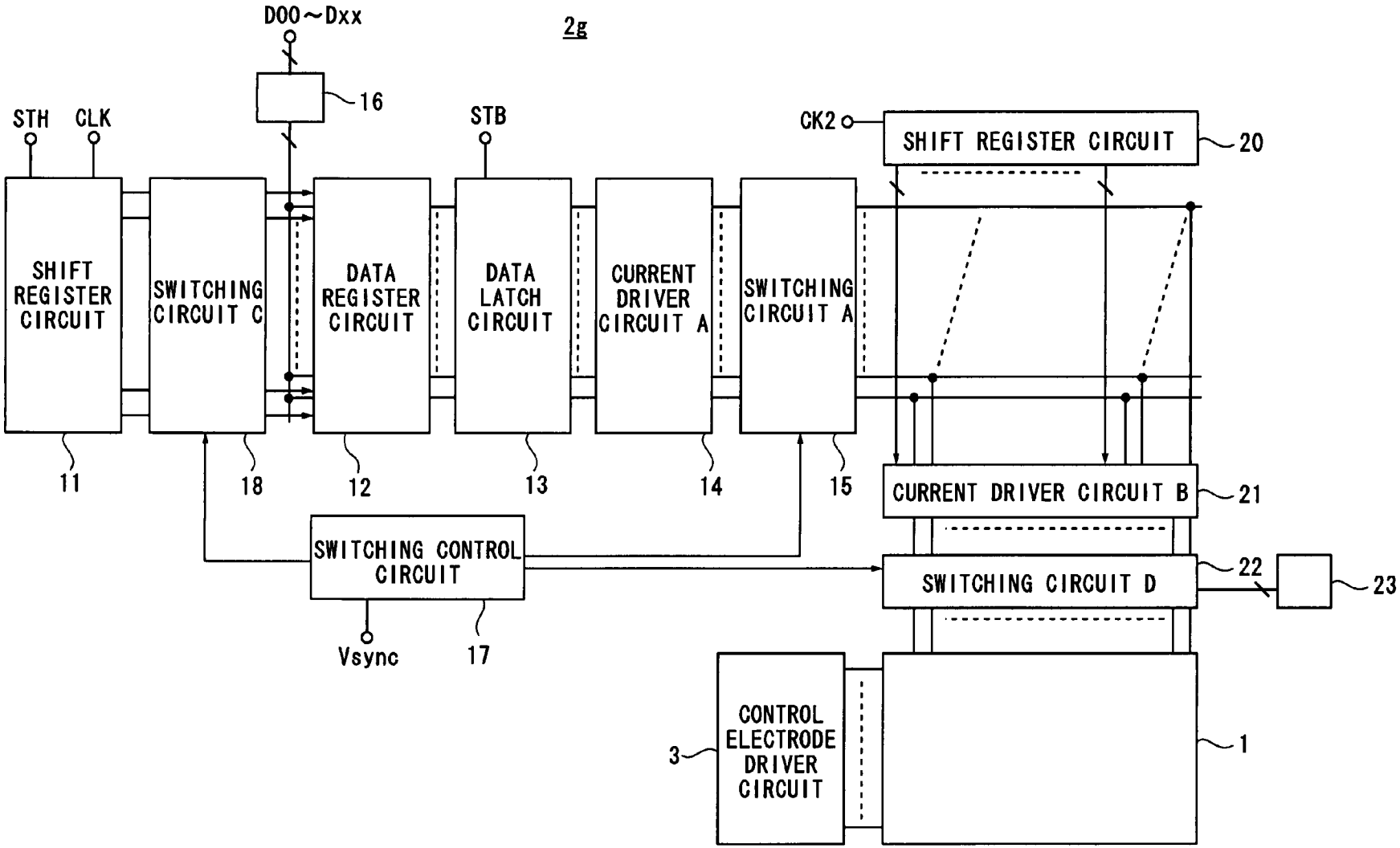
FIG. 16 is a data electrode driver circuit of another embodiment of the present invention.

FIG. 13 shows a timing chart.

One frame period is divided into an R light emission period, a G light emission period, a B light emission period, and a non-light-emission period. V1_* (where * is R, G, B) scans the first line of control electrodes and, similarly, Vj_* scans the j line of the control electrodes.

Figure 12C:
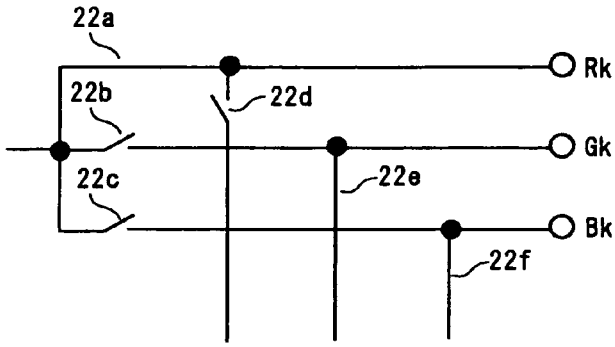

In the R light emission period, as shown in FIG. 12C, the switches 22*a*, 22*e*, and 22*f* of the switching circuit D 22 are turned ON and switches 22*b*, 22*c*, and 22*d* are turned OFF. When the control electrodes are scanned in order, only the data electrode Rk is driven at the current values corresponding with the image signal, the data electrodes Gk and Bk being driven at the non-light-emission level voltage by drivers 23*g* and 23*b* via the switches 22*e* and 22*f*.

Figure 12D:
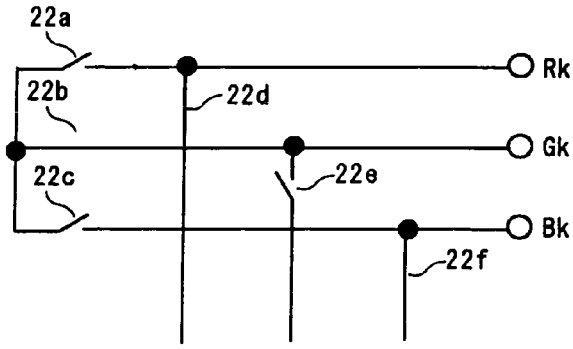

Similarly, in the light emission period G, as shown in FIG. 12D, when the switches 22*b*, 22*d*, and 22*f* are turned ON, the switches 22*a*, 22*c*, and 22*e* are turned OFF, and the control electrodes are scanned in order, only the data electrode Gk is driven at the current values corresponding with the image signal, the data electrodes Rk and Bk being driven at the non-light-emission level voltage.

Figure 12E:
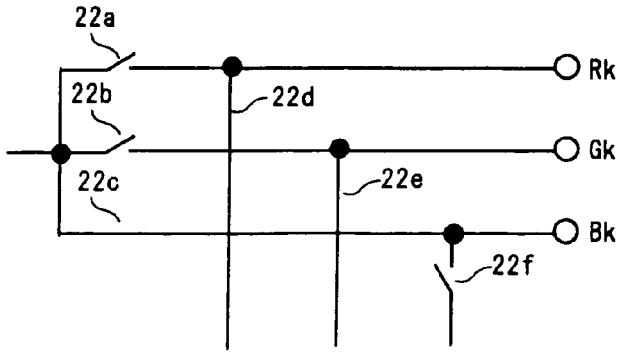

In the B light emission period, as shown in FIG. 12E, when the switches 22*c*, 22*d*, and 22*e* are turned ON, switches 22*a*, 22*b*, and 22*f* are turned OFF, and the control electrodes are scanned in order, only the data electrode Bk is driven at current values that correspond with the image signal, data electrodes Rk and Gk being driven at the non-light-emission level voltage.

In addition, in the non-light-emission period, when the switches 22*d*, 22*e*, and 22*f* are turned ON, the switches 22*a*, 22*b*, and 22*c* are turned OFF and the control electrodes are scanned in order, all the electrodes are driven at the non-light-emission level.

The respective lengths of the non-light-emission period and light-emission periods of each color allow a favorable display to be obtained through variation that depends on the light-emission characteristics of the light-emitting material. When the non-light-emission period is extended, the light emission period of each color grows shorter and, therefore a large current value flows to the light emitting element in order for the same brightness to be obtained, meaning that the lifespan is shortened.

Nevertheless, in comparison with a passive-matrix-type display device, because the current value flowing to the light-emitting elements can be reduced, the lifespan grows longer. Given 360 vertical-side pixels, the duty=1/360. In the case of an active-type display device, the lifespan can be lengthened without degrading the display by changing the light emission period to the non-light-emission period irrespective of the number of pixels. Therefore, an optional period from 1/3 to 1/360 can be allocated. With an organic EL element, because the light emission characteristic differs for each color, a favorable display can be obtained by making the frame cycle and subframe periods appropriate.

Therefore, by providing the switching circuit D 22, which allows a plurality of data electrodes to be driven using time division by one current driver, between the switching circuit A 15 and the data electrodes, the circuit scale of the data electrode driver circuit 2 can be made approximately 1/3.

Further, the provision of a non-light-emission period makes it possible to enlarge the minimum current value of the current driver circuit A 14, and therefore the influence of minute leakage caused by the switching circuit A can be reduced.

Sixth Embodiment

Figure 23:
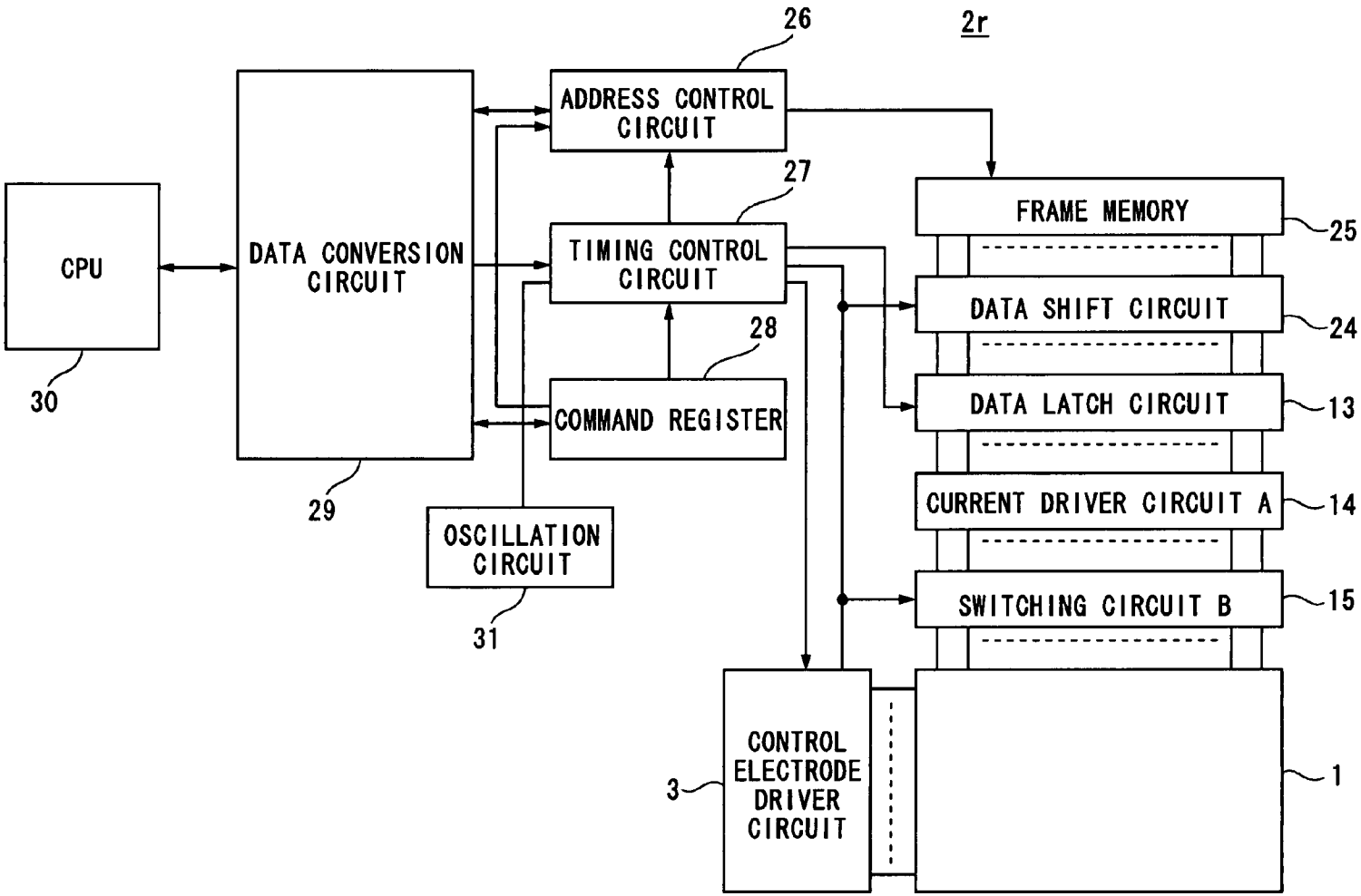
FIG. 23 is a data electrode driver circuit of a sixth embodiment of the present invention.

FIG. 23 shows a block diagram for when the data electrode driver circuit 2 comprises a frame memory.

A digital image signal that is serially inputted in sync with clocks is inputted and expanded in the data conversion circuit 16 in the first to fifth embodiments. However, when the data electrode driver circuit is provided with a frame memory, because signals are transferred from the frame memory to the line memory altogether without clock synchronization, the image signals cannot be expanded in number order. Hence, the image signal can be shifted by providing a function to shift the image signal to a line memory unit.

Figure 24:
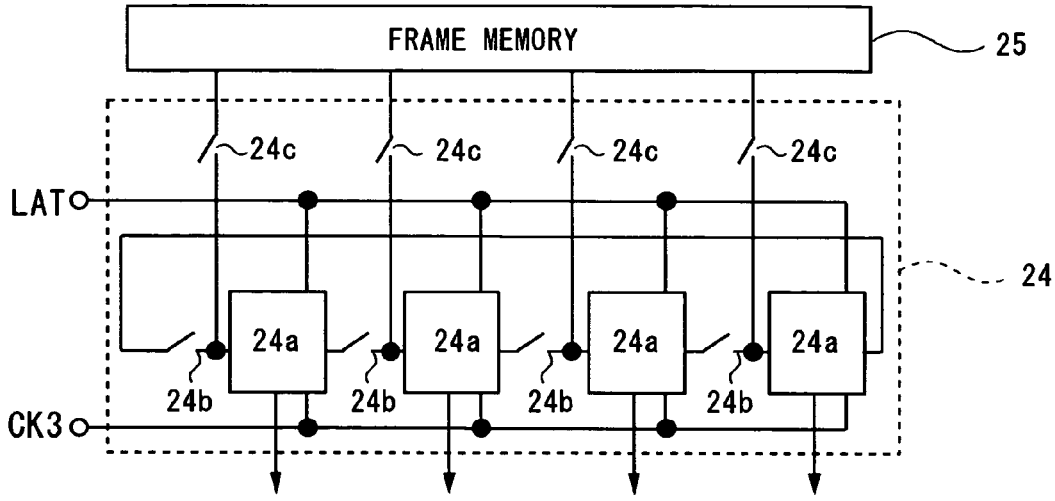
FIG. 24 provides a detailed view of a data shift circuit of the sixth embodiment of the present invention.

FIG. 24 provides a detailed view of a data shift circuit.

The data shift circuit is constituted by a plurality of FF circuits 24*a* and a plurality of switches 24*b* and 24*c*. The respective FF circuits 24*a* are connected by means of switches 24*b* and the FF circuit 24*a* and frame memory are connected by means of switches 24*c*.

The operation will be described next.

In order for the image signal to be received from the frame memory, switches 24*c* are turned ON and switches 24*b* are turned OFF, and the latch signal LAT is inputted to hold the image signal. Thereafter, switches 24*c* are turned OFF and switches 24*b* are turned ON, and, when a predetermined number of clocks are operated, the image signal is shifted in order. A timing control circuit 27 determines the number of times to perform shifting, the direction of shifting, and so forth, for correspondence between the image signal and the data electrodes, and performs control in sync with the switching circuit B.

Although described in the first to sixth embodiments above, the driver circuit may comprise the current driver circuit A 14, which converts at least a digital image signal into an analog current value, the switching circuit A 15, and switching control circuit 17, and further comprise, as means for expanding at least digital image data, either a shift register circuit, the switching circuit B 10, which switches the position of the start signal that is input to the shift register circuit, and the data register circuit 12, or a shift register circuit, switching circuit C 18, which switches the sampling signal generated by the shift register circuit, and the data register circuit 12, or a data shift circuit 24, which shifts the held image data itself. The driver circuit have the switching circuit D for switching time-division driving and the current driver circuit B, and so forth.

Moreover, each of the circuits shown in the first to sixth embodiments may be fabricated on a semiconductor integrated device such as a silicon substrate or may be fabricated on a glass substrate.

In addition, the switching circuit A 15, shift register circuit 20, and current driver circuit B 21 may be fabricated on a glass substrate and the other circuits may be fabricated on a silicon substrate.

As described hereinabove, the present invention expands and holds a plurality of serially inputted digital image signals in parallel, generates gradation currents corresponding with the digital image signals, and controls at least the order of the expansion of the digital image signals, the direction thereof, or the number of rotations thereof, whereby it is possible to provide a display-device driver circuit and a drive method thereof with improved image quality without enlarging the circuit scale of the data electrode driver circuit.

It is apparent that the present invention is not limited to the above embodiment, that may be modified and changed without departing from the scope and spirit of the invention.

What is claimed is:

1. A drive method for a matrix display device in which a plurality of control electrodes provided at predetermined intervals, a plurality of data electrodes provided at predetermined intervals, and respective pixel circuits at points of intersection between the control electrodes and data electrodes are arranged, comprising:

dividing a frame cycle into at least four subframe cycles;

writing a predetermined image signal to the pixel circuits that emit light of a first color and non-light-emission voltage values to the pixel circuits that emit light of a second and a third color in a first subframe cycle;

writing a predetermined image signal to the pixel circuits that emit light of the second color and non-light-emission voltage values to the pixel circuits that emit light of the first and the third color in a second subframe cycle;

writing a predetermined image signal to the pixel circuits that emit light of the third color and non-light-emission voltage values to the pixel circuits that emit light of the first and the second color in a third subframe cycle; and writing non-light-emission voltage values to the pixel circuits that emit light of the first, the second and the third color in a fourth subframe cycle, wherein the respective time periods of the first, the second, the third, and the fourth subframe cycles are the same, wherein the step of writing a predetermined image signal to the pixel circuits that emit light of the first color is performed by selecting a first input switch, a second output switch, and a third output switch, wherein the step of writing a predetermined image signal to the pixel circuits that emit light of the second color is performed by selecting a second input switch, a first output switch, and the third output switch, and wherein the step of writing a predetermined image signal to the pixel circuits that emit light of the third color is performed by selecting a third input switch, the first output switch and the second output switch.

2. A drive method for a matrix display device in which a plurality of control electrodes provided at predetermined intervals, a plurality of data electrodes provided at predetermined intervals, and respective pixel circuits at points of intersection between the control electrodes and data electrodes are arranged, comprising:

dividing a frame cycle into at least four subframe cycles;

writing a predetermined image signal to the pixel circuits that emit light of a first color and non-light-emission voltage values to the pixel circuits that emit light of a second and a third color in a first subframe cycle;

writing a predetermined image signal to the pixel circuits that emit light of the second color and non-light-emission voltage values to the pixel circuits that emit light of the first and the third color in a second subframe cycle;

writing a predetermined image signal to the pixel circuits that emit light of the third color and non-light-emission voltage values to the pixel circuits that emit light of the first and the second color in a third subframe cycle; and writing non-light-emission voltage values to the pixel circuits that emit light of the first, the second and the third color in a fourth subframe cycle, wherein the respective time periods of the first, the second, the third, and the fourth subframe cycles differ from each other, wherein the step of writing a predetermined image signal to the pixel circuits that emit light of the first color is performed by selecting a first input switch, a second output switch, and a third output switch, wherein the step of writing a predetermined image signal to the pixel circuits that emit light of the second color is performed by selecting a second input switch, a first output switch, and the third output switch, and wherein the step of writing a predetermined image signal to the pixel circuits that emit light of the third color is performed by selecting a third input switch, the first output switch and the second output switch.

* * * * *